United States Patent [19]

Kashiwagi et al.

[11] Patent Number: 4,584,445

[45] Date of Patent: Apr. 22, 1986

[54] VACUUM INTERRUPTER

[75] Inventors: Yoshiyuki Kashiwagi; Yasushi Noda; Kaoru Kitakizaki, all of Tokyo, Japan

[73] Assignee: Kabushiki Kaisha Meidensha, Tokyo, Japan

[21] Appl. No.: 589,295

[22] Filed: Mar. 14, 1984

[30] Foreign Application Priority Data

| | | | |
|---|---|---|---|
| Mar. 15, 1983 | [JP] | Japan | 58-43991 |
| Aug. 30, 1983 | [JP] | Japan | 58-159206 |
| Aug. 30, 1983 | [JP] | Japan | 58-159207 |
| Sep. 30, 1983 | [JP] | Japan | 58-183647 |
| Sep. 30, 1983 | [JP] | Japan | 58-183649 |
| Sep. 30, 1983 | [JP] | Japan | 58-183650 |
| Oct. 3, 1983 | [JP] | Japan | 58-184902 |

[51] Int. Cl.[4] ..... H01H 33/66

[52] U.S. Cl. ..... 200/144 B; 200/265; 200/266; 29/875; 75/246

[58] Field of Search ..... 200/144 B, 265, 266; 29/874, 875; 75/134 C, 134 F, 245, 246, 247

[56] References Cited

U.S. PATENT DOCUMENTS

| | | | |
|---|---|---|---|
| 3,246,979 | 4/1966 | Lafferty et al. | 75/134 |
| 3,596,027 | 7/1971 | Okutomi et al. | 200/144 B |
| 3,811,939 | 5/1974 | Hassler et al. | 117/227 |
| 3,825,789 | 7/1974 | Harris | 200/144 B |
| 3,946,179 | 3/1976 | Murano et al. | 200/144 B |
| 3,957,453 | 5/1976 | Haessler et al. | 29/182.1 |
| 4,260,864 | 4/1981 | Wayland et al. | 200/144 B |
| 4,372,783 | 2/1983 | Kato | 75/246 |

FOREIGN PATENT DOCUMENTS

| | | |
|---|---|---|
| 0101024 | 2/1984 | European Pat. Off. . |
| 0113962 | 7/1984 | European Pat. Off. . |
| 2240493 | 9/1974 | Fed. Rep. of Germany . |
| 2947090 | 6/1980 | Fed. Rep. of Germany . |
| 3027732 | 2/1981 | Fed. Rep. of Germany . |
| 57-199126 | 12/1982 | Japan . |
| 2024257 | 1/1980 | United Kingdom . |
| 2024258 | 1/1980 | United Kingdom . |
| 2027449 | 2/1980 | United Kingdom . |

*Primary Examiner*—Robert S. Macon

*Attorney, Agent, or Firm*—Schwartz, Jeffery, Schwaab, Mack, Blumenthal & Evans

[57] ABSTRACT

A vacuum interrupter of more improved large current interrupting capability and dielectric strength is disclosed. The interrupter has a pair of separable contact-electrodes (13, 24), a vacuum envelope (4) generally electrically insulating and enclosing the pair therewithin, a contact-making portion (19) of 20 to 60% IACS electrical conductivity being a part of one contact-electrode (13) of the pair and being into and out of engagement with the other contact-electrode (24) of the pair, an arc-diffusing portion (20) of 2 to 30% IACS electrical conductivity being the other part of the one contact-electrode (13) and being electrically and mechanically connected to the contact-making portion (19) so as to be spaced from the other contact-electrode (24) when the contact-electrodes (13, 24) are into engagement, and means (14, 15) for applying an axial magnetic field in parallel to an arc established between the contact-electrodes (13, 24) when separated.

19 Claims, 43 Drawing Figures

VACUUM INTERRUPTER

BACKGROUND OF THE INVENTION

1. Field of the Invention

The present invention relates to a vacuum interrupter used with an electric circuit of high power, for example, an alternating current circuit of high power. More particularly, the invention pertains to a vacuum interrupter including means for applying a magnetic field to an arc in parallel to a longitudinal axis of the arc (hereinafter, the magnetic field is referred to as an axial magnetic field) which is established across a space between a pair of contact-electrodes within a vacuum envelope of the vacuum interrupter when the contact-electrodes are into in or out of engagement, thus enhancing current interruption capability of the vacuum interrupter.

2. Description of the Prior Art

Recently, it has been required to provide a vacuum interrupter of much enhanced large current interrupting capability and dielectric strength to cope with increasing current and voltage of power lines with an expansion of an electric power supply network.

A vacuum interrupter employing an axial magnetic field, which includes a pair of contact-electrodes, restricts the electric arc to a space between the contact-electrodes with the applied axial magnetic field uniformly diffusing the arc in the space, when the contact-electrodes are separated, thus preventing any concentrating arc-spot of the contact-electrodes from locally overheating and thus enhancing the current interruption capability and dielectric strength thereof.

Generally, the contact-electrode itself is required to consistently satisfy the following requirements:

(i) low electrical resistivity,
(ii) high current interruption capability,
(iii) high dielectric strength,
(iv) high anti-welding capability,
(v) high leading and lagging small current interruption capabilities,
(vi) low amount of chopping current, and
(vii) low erosion.

However, a contact-electrode to consistently satisfy all the above requirements, in the present state of the art, has not been provided.

For example, a disc-shaped contact-electrode of copper which includes a plurality of radial slits is presented as a contact-electrode of a well-known vacuum interrupter of an axial magnetic field applying type. The disc-shaped and slitted contact-electrode has certain advantages in that it reduces eddy currents so as not to weaken the axial magnetic field. However, the small tensile strength of copper, which amounts to 20 kgf/mm$^2$ (196.1 MPa), and the plurality of slits cause mechanical strength of the disc-shaped and slitted contact-electrode to be much reduced. Thus, the thickness and weight of the contact-electrode must be increased in order to prevent a deformation of the contact-electrode due to the mechanical impact and electromagnetic force from large currents which are applied to the contact-electrode when the vacuum interrupter is closed and opened.

In addition, electric fields and multiple arcs are concentrated at edge portions of the slits which reduces the dielectric strength between the contact-electrodes, particularly the dielectric strength after an interruption of a large current (hereinafter, referred to as dynamic dielectric strength) and erodes the contact-electrode (refer to U.S. Pat. No. 3,946,179).

In addition, there are known as examples of a pair of contact-electrodes of a vacuum interrupter of an arc driving type but not as those of a pair of contact-electrodes of the vacuum interrupter of the axial magnetic field applying type, various contact-electrodes, which are adapted for large currents of low voltage. These contact-electrodes are made of copper alloyed with a minor constituent of a low melting point and a high vapor-pressure, such as a contact-electrode of copper alloyed with 0.5% bismuth by weight (hereinafter, referred to as a Cu-0.5Bi alloy) which is disclosed in the U.S. Pat. No. 3,246,979, or a contact electrode which is disclosed in the U.S. Pat. No. 3,596,027.

Such contact-electrodes of copper alloyed with a minor constituent of a low melting point and high vapor-pressure as a contact-electrode of Cu-0.5Bi alloy are excellent in large current interrupting capability, electrical conductivity and anti-welding capability, whereas significantly low in dielectric strength, particularly in dynamic dielectric strength. In particular, a current chopping value of a pair of contact-electrodes of Cu-0.5Bi alloy amounts to 10A, being relatively high, so that it happens to cause harmful chopping surges in the current interruption. Thus, a pair of contact-electrodes of Cu-0.5Bi alloy are not well suited in lagging small current interrupting capability, which happens to lead to dielectric breakdown of electrical devices of inductive load circuits.

For overcoming the drawbacks of the contact-electrode of copper alloyed with a minor constituent of a low melting point and a high vapor-pressure, there are known various contact-electrode of alloy consisting of copper and a material of a high melting point and a low vapor-pressure, such as a contact-electrodes of alloys consisting of 20% copper by weight and 80% tungsten by weight (hereinafter, referred to as a 20Cu-80W alloy) which is disclosed in the U.S. Pat. No. 3,811,939, or a contact-electrode which is disclosed in the GB-No. 2,024,257A.

Such contact-electrode of alloys consisting of copper and a material of a high melting point and a low vapor-pressure as a contact-electrode of 20Cu–80W alloy above is relatively high in static dielectric strength, whereas relatively low in large current interrupting capability.

SUMMARY OF THE INVENTION

An object of the present invention is to provide a vacuum interrupter of an axial magnetic field applying type which is excellent in large current interrupting capability and dielectric strength.

Another object of the present invention is to provide a vacuum interrupter of an axial magnetic field applying type which possesses high resistance against mechanical impact and electromagnetic forces based on large currents, therefore, long period durability.

In attaining these objects, a vacuum interrupter of the present invention includes a pair of separable contact-electrodes, a vacuum envelope which is generally electrically insulating and enclosing the pair of separable contact-electrodes therewithin, a contact-making portion of material of 20 to 60% IACs electrical conductivity, being a part of at least one contact-electrode of the pair which means into and out of engagement with the other contact-electrode, an arc-diffusing portion of material of 2 to 30% IACS electrical conductivity, being the other part of the one contact-electrode and being electrically and mechanically connected to the contact-making portion so as to be spaced from the other contact-electrode when the pair of contact-electrodes are in engagement, and means for applying an axial magnetic field to an arc established between the separated contact-electrodes.

Other objects and advantages the present invention will be apparent from the following description, claims and attached drawings and photographs.

BRIEF DESCRIPTION OF THE DRAWINGS

FIGS. 7A to 7D all are photographs by an X-ray microanalyzer of a structure of Example $A_1$ of a complex metal constituting an arc-diffusing portion, of which:

FIG. 7A is a secondary electron image photograph of the structure.

FIG. 7B is a characteristic X-ray image photograph of iron.

FIG. 7C is a characteristic X-ray image photograph of chromium.

FIG. 7D is a characteristic X-ray image photograph of infiltrant copper.

FIGS. 8A to 8D all are photographs by the X-ray microanalyzer of a structure of Example $A_2$ of a complex metal constituting an arc-diffusing portion, of which:

FIG. 8A is a secondary electron image photograph of the structure.

FIG. 8B is a characteristic X-ray image photograph of iron.

FIG. 8C is a characteristic X-ray image photograph of chromium.

FIG. 8D is a characteristic X-ray image photograph of infiltrant copper.

FIGS. 9A to 9D all are photographs by the X-ray microanalyzer of a structure of Example $A_3$ of a complex metal constituting the arc-diffusing portion, of which:

FIG. 9A is a secondary electron image photograph of the structure.

FIG. 9B is a characteristic X-ray image photograph of iron.

FIG. 9C is a characteristic X-ray image photograph of chromium.

FIG. 9D is a characteristic X-ray image photograph of infiltrant copper.

FIGS. 10A to 10D all are photographs by the X-ray microanalyzer of a structure of of Example $C_1$ of a complex metal constituting a contact-making portion, of which:

FIG. 10A is a secondary electron image photograph of the structure.

FIG. 10B is a characteristic X-ray image photograph of molybdenum.

FIG. 10C is a characteristic X-ray image photograph of chromium.

FIG. 10D is a characteristic X-ray image photograph of infiltrant copper.

FIGS. 11A to 11D all are photographs by the X-ray microanalyzer of a structure of Example $C_2$ of a complex metal constituting the contact-making portion, of which:

FIG. 11A is a secondary electron image photograph of the structure.

FIG. 11B is a characteristic X-ray image photograph of molybdenum.

FIG. 11C is a characteristic X-ray image photograph of chromium.

FIG. 11D is a characteristic X-ray image photograph of infiltrant copper.

FIGS. 12A to 12D all are photographs by the X-ray microanalyzer of a structure of Example $C_3$ of a complex metal constituting the contact-making portion, of which:

FIG. 12A is a secondary electron image photograph of the structure.

FIG. 12B is a characteristic X-ray image photograph of molybdenum.

FIG. 12C is a characteristic X-ray image photograph of chromium.

FIG. 12D is a characteristic X-ray image photograph of infiltrant copper.

FIGS. 13A to 13D all are photographs by the X-ray microanalyzer of a structure of Example $A_4$ of a complex metal constituting the arc-diffusing portion, of which:

FIG. 13A is a secondary electron image photograph of the structure.

FIG. 13B is a characteristic X-ray image photograph of iron.

FIG. 13C is a characteristic X-ray image photograph of chromium.

FIG. 13D is a characteristic X-ray image photograph of infiltrant copper.

FIGS. 14A to 14D all are photographs by the X-ray microanalyzer of a structure of Example $A_7$ of a complex metal constituting the arc-diffusing portion, of which:

FIG. 14A is a secondary electron image photograph of the structure.

FIG. 14B is a characteristic X-ray image photograph of iron.

FIG. 14C is a characteristic X-ray image photograph of chromium.

FIG. 14D is a characteristic X-ray image photograph of infiltrant copper.

FIGS. 15A to 15E all are photographs by the X-ray microanalyzer of a structure of Example $A_{10}$ of a complex metal constituting the arc-diffusing portion, of which:

FIG. 15A is a secondary electron image photograph of the structure.

FIG. 15B is a characteristic X-ray image photograph of iron.

FIG. 15C is a characteristic X-ray image photograph of chromium.

FIG. 15D is a characteristic X-ray image photograph of nickel.

FIG. 15E is a characteristic X-ray image photograph of infiltrant copper.

DESCRIPTION OF THE PREFERRED EMBODIMENT

Figure 1:
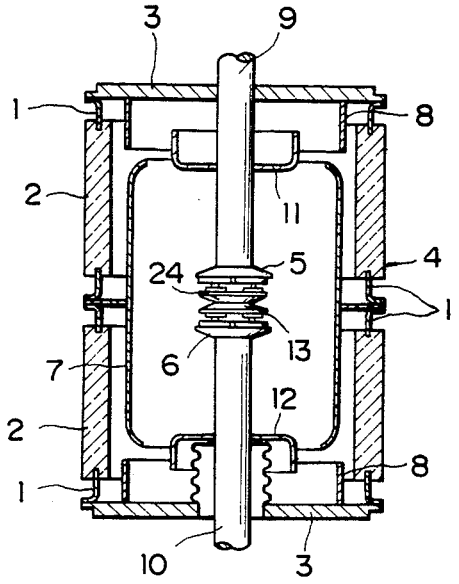
FIG. 1 is a sectional view through a vacuum interrupter of an axial magnetic field applying type according to the present invention.

Referring to FIGS. 1 to 15 of the accompanying drawings and photographs, preferred embodiments of the present invention will be described in detail. As shown in FIG. 1, a vacuum interrupter of a first embodiment of the present invention includes a vacuum envelope 4 which is evacuated to less than $10^{-4}$ Torr (13.4 mPa) and a pair of stationary and movable electrode assemblies 5 and 6 located within the vacuum envelope 4. The vacuum envelope 4 comprises, in the main, two the same-shaped insulating cylinders 2 of glass or alumina ceramics which are serially and hermetically associated by welding or brazing to each other by means of sealing metallic rings 1 of Fe-Ni-Co alloy of Fe-Ni alloy at the adjacent ends of the insulating cylinders 2, and a pair of metallic end plates 3 of austinitic stainless steel hermetically associated by welding or brazing to both the remote ends of the insulating cylinders 2 by means of sealing metallic raings 1. A metallic arc shield 7 of a cylindrical form which surrounds the electrode assemblies 5 and 6 is supported on and hermetically joined by welding or brazing to the sealing metallic rings at the adjacent ends of the insulating cylinders 2. Further, metallic edge-shields 8 which moderate electric field concentration at edges of the sealing metallic rings 1 at the remote ends of the insulating cylinders 2 are joined by welding or brazing to the pair of metallic end plates 3. An axial shield 11 and a bellows shield 12 are provided on respective stationary and movable lead rods 9 and 10 which are electrically and mechanically joined to the respective stationary and movable electrode assemblies 5 and 6. The arc shield 7, the edge shield 8, the axial shield 11 and the bellows shield 12 all are made of austinitic stainless steel.

Figure 2:
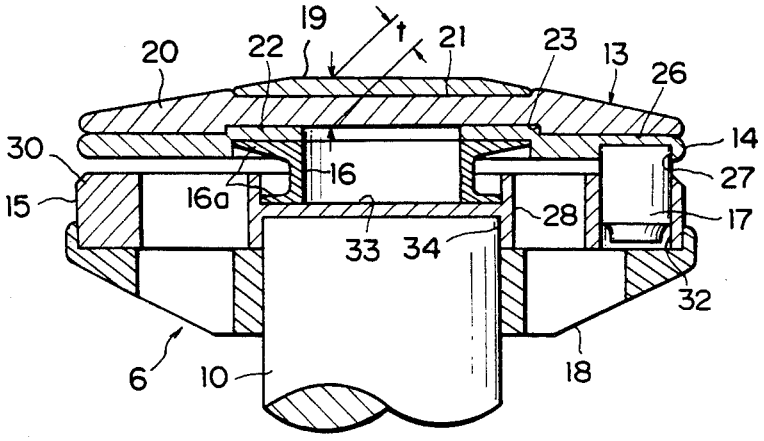
FIG. 2 is a sectional view through the movable electrode assembly of FIG. 1.
Figure 3:
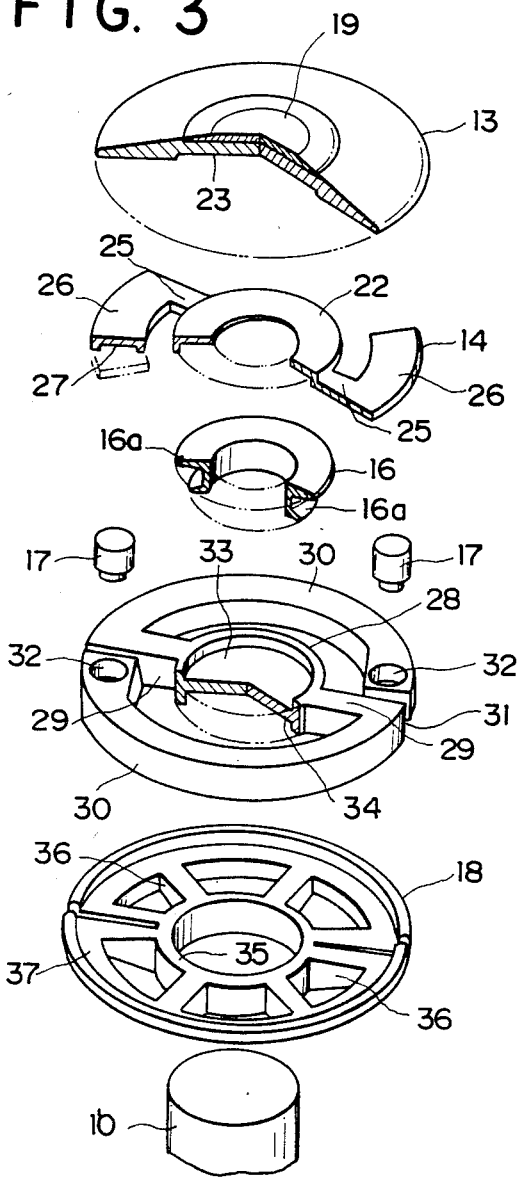
FIG. 3 is an exploded perspective view of the movable electrode assembly of FIG. 2.

The electrode assemblies 5 and 6 have the same construction and the movable electrode assembly 6 will be described hereinafter. As shown in FIGS. 2 and 3, the movable electrode assembly 6 comprises a movable contact-electrode 13, an electrical lead member 14 for a coil-electrode of which all portions are electrically and mechanically joined by brazing to the backsurface of the movable contact-electrode 13, a coil-electrode 15 which is mechanically and electrically joined by brazing to the inner end of the movable lead rod 10, spaced from the electrical lead member 14 for the coil-electrode, a spacer 16 both ends of which rigidly connect the central portions of the electrical lead member 14 for the coil-electrode and the coil-electrode 15 to each other but substantially electrically insulated from each other and which is positioned between the electrical lead member 14 for the coil-electrode and the coil-electrode 15, electrical connectors 17 in a columnar form which electrically connect the outer peripheries of the electrical lead member 14 for the coil-electrode and the coil-electrode 15, and a reinforcement member 18 for the coil-electrode 15.

The members listed above will be successively described in detail.

As shown in FIGS. 2 and 3, the movable contact-electrode 13 which generally takes the form of a thinned frustrum of a cone consists of a contact-making portion 19 and an arc-diffusing portion 20 electrically and mechanically joined by brazing to the contact-making portion 19.

The contact-making portion 19 is made of material of 20 to 60% IACS electrical conductivity, for example, complex metal consisting of 20 to 70% copper by weight, 5 to 70% chromium by weight and 5 to 70% molybdenum by weight. In this case, the contact-making portion 19 can exhibit equivalently the same electrical contact resistance due to its thin disc-shape as a contact-making member of Cu-0.5Bi alloy. The contact-making portion 19 which is shaped as a frustrum of a circular cone is also fitted into a circular recess 21 which is formed in the central portion of the surface of arc-diffusing portion 20, and projecting from the surface of the arc-diffusing portion 20. For reducing as much as possible the amount of eddy currents created in the movable contact-electrode 13, the diameter of the contact-making portion 19 is made between 20 to 60% of a diameter of the arc-diffusing portion 20.

The arc-diffusing portion 20 is made of material of 2 to 30%, preferably, 10 to 15% IACS electrical conductivity, for example, material containing copper, iron and chromium. For example, there are mentioned as the latter material a complex metal of about 30 kgf/mm$^2$ (294 MPa) tensile strength consisting of 50% copper by weight and 50% austinitic stainless steel by weight, e.g., SUS 304 or SUS 316 (at JIS, hereinafter, at the same), and a complex metal of about 30 kgf/mm$^2$ (294 MPa) tensile strength consisting of 50% copper by weight, 25% iron by weight and 25% chromium by weight. The arc-diffusing portion 20 is shaped substantially as a frustrum of circular cone so that the surface of the arc-diffusing portion 20 has a slant associated with that of the surface of the contact-making portion 19. The arc-diffusing portion 20 also includes a circular recess 23 at the central portion of the backsurface thereof. An annular hub 22 of the electrical lead member 14 for the coil-electrode is fitted into the circular recess 23.

A thickness t of the central portion of the movable contact-electrode 13 is made at most 10 mm in view of the generation of Joule heat produced when the stationary and movable contact-electrodes 24 and 13 are in contact.

The electrical lead member 14 for the coil-electrode, an outer diameter of which is normally no more than the diameter of the movable contact-electrode 13, is made of material of high electrical conductivity such as Cu, Ag, Cu alloy or Ag alloy. The electrical conductivity of that material is much larger than that of a material of the arc-distributing portion 20.

As shown in FIG. 3, the electrical lead member 14 for the coil-electrode includes the hub 22, two radial webs 25 oppositely extending from the hub 22 and two arcuate bridges 26 extending in a common circumferential direction from the outer ends of the respective radial webs 25. The hub 22, radial webs 25 and angular bridges 26, as described above, all are electrically and mechanically joined by brazing to the backsurface of the movable contact-electrode 13. A circular recess 27 to which one end of the electrical connector 17 is brazed is provided in the backsurface of the distal end of each angular bridge 26. The electrical lead member 14 for the coil-electrode serves to carry most of the current which, in absence of the electrical lead member 14, flows through the movable contact-electrode 13 alone in a radial direction thereof thereby raising the temperature of the movable contact-electrode 13 due to Joule heating. Electrical lead member 14 thus prevents such large temperatures.

The coil-electrode 15 which serves to establish the major part of axial magnetic field is made of material of high electrical conductivity, e.g., Cu, Ag, Cu alloy or Ag alloy as is the electrical lead member 14 for the coil-electrode. As shown in FIG. 3, the coil-electrode 15 includes a circular hub 28, two radial webs 29 oppositely extending from the circular hub 28, and two partially turning segments 30 extending in a common circumferential direction from outer ends of the respective radial webs 29. The direction of an extension of the partially turning segments 30 is opposite to the direction of an extension of the bridges 26. An angular gap 31 is provided between the adjacent distal end of each partially turning segment 30 and each radial web 29. A circular hole 32 into which a part of the electrical connector 17 is secured by means of brazing is provided at the distal end of each partially turning segment 30.

A circular recess 33 into which an outwardly extending flange 16*a* at one end of the spacer 16 is secured by means of brazing is provided in the surface of the hub 28, on the other hand, a circular recess 34 into which the inner end of the movable lead rod 10 is secured by means of brazing is provided in the backsurface of the hub 28.

The coil-electrode 15 of FIG. 3 is a $\frac{1}{2}$ turn type, however, may be of a $\frac{1}{3}$, $\frac{1}{4}$ or one turn type.

The spacer 16 rigidly connects the electrical lead member 14 for the coil-electrode and the coil electrode 15 to each other in a manner to space them apart. The spacer 16 is also made of material of high mechanical strength, good brazability, and of such low electrical conductivity that the electrical lead member 14 for the coil-electrode and the coil-electrode 15 are effectively insulated from one another. Thus, for example, stainless steel or Inconnel may be used.

Further, the spacer 16, which is shaped as a short cylinder having a pair of outwardly extending flanges 16*a* at the opposite ends thereof, is brazed at both the outwardly extending flanges 16*a* to the hubs 22 and 28 of the electrical lead member 14 for the coil-electrode and the coil-electrode 15.

The reinforcement member 18 is made of material of high mechanical strength and low electrical conductivity, e.g., stainless steel, as well as the spacer 16. The reinforcement member 18 includes a hub 35 brazed to a periphery of the movable lead rod 10, a plurality of supporting arms 36 radially extending from the hub 35, and two limbs 37 which is integrated to the outer ends of the supporting arms 36 and includes upward flanges. The limbs 37 are brazed to the partially turning segments 30 of the coil-electrode 15.

There was carried out a performance comparison test between a vacuum interrupter of an axial magnetic field applying type according to the first embodiment of the present invention, and a conventional vacuum interrupter of an axial magnetic field applying type (refer to U.S. Pat. No. 3,946,179). The former interrupter includes a pair of contact-electrodes each of which consists of a contact-making portion of complex metal consisting of 50% copper by weight. 10% chromium by weight and 40% molybdenum by weight, and an arc-diffusing portion of complex metal consisting of 50% copper by weight and 50% SUS 304 by weight. A diameter of the contact-making portion is 20% of a diameter of the arc-diffusing portion. The latter interrupter includes a pair of disc-shaped contact-electrodes of Cu-0.5Bi alloy, each of the pair has six linear slits extending radially from an outer periphery and a $\frac{1}{4}$ turn typed coil.

Results of the performance comparison test will be described as follows:

In the specification, amounts of voltage and current are represented in a rms value if not specified.

(1) Large current interrupting capability

Figure 4:
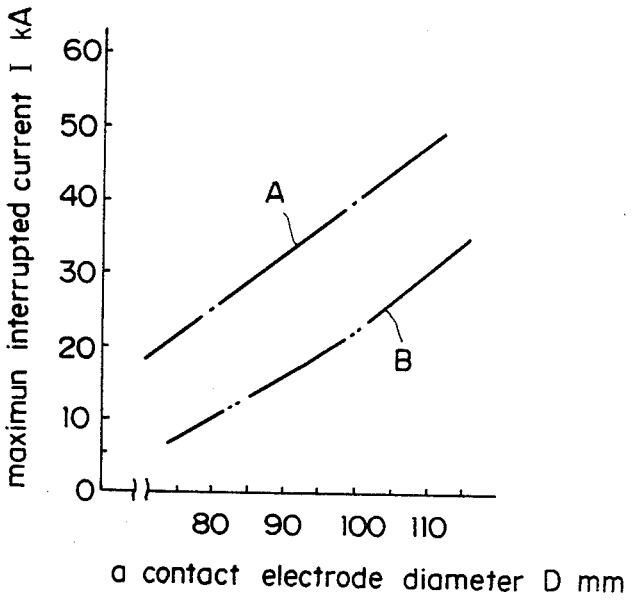
FIG. 4 is a diagram illustrative of a relation determined under 84 kV between each contact-electrode diameter D and maximum interruption current I.

Maximum interruption current I(kA) was measured at rated 84 kV when a diameter D(mm) of each contact-electrode was varied. FIG. 4 shows results of the measurement. In FIG. 4, the axis of ordinate represents maximum interruption current I and the axis of abscissa represents the diameter D of each contact-electrode. Line A represents a relationship between the maximum interruption current I and the diameter D of each contact-electrode relative to a vacuum interrupter of the present invention. Line B indicates a relationship between the maximum interruption current I and the diameter D of each contact-electrode relative to a conventional vacuum interrupter.

As apparent from FIG. 4, the vacuum interrupter according to the first embodiment of the present invention exhibits 2 to 2.5 times large current interrupting capability as that of the conventional vacuum interrupter.

(2) Dielectric strength

In accordance with JEC-181 test method, withstand voltages were measured of the vacuum interrupter of the first embodiment of the present invention and the conventional vacuum interrupter, with a 3.0 mm gap between contact-making portions relative to the present invention but with a 10 mm gap between contact-making portions relative to the conventional vacuum interrupter. In this case, both the vacuum interrupters exhibited the same withstand voltage. Thus, the vacuum interrupter of the present invention possesses 3 times the dielectric strength as that of the conventional vacuum interrupter.

There were also measured before and after large current interruption withstand voltages for the first embodiment of the present invention, and the conventional vacuum interrupter. The withstand voltage after large current interruption of the former interrupter decreased to about 80% of the withstand voltage before large current interruption thereof. On the other hand, the withstand voltage after large current interruption of the latter interrupter decreased to about 30% of the withstand voltage before large current interruption thereof.

(3) Anti-Welding capability

The anti-welding capability of the contact-electrodes of the first embodiment of the present invention amounted to 80% of the anti-welding capability of those of the conventional vacuum interrupter. However, such decrease is not actually significant. If necessary, a disengaging force applied to the contact-electrodes may be slightly enhanced.

(4) Lagging small current interrupting capability

A current chopping value of the vacuum interrupter of the first embodiment of the present invention amounted to 40% of that of the conventional vacuum interrupter, so that a chopping surge was almost insignificant. This value was maintained even after engaging and disengaging the contact-electrodes for more than 100 times for interrupting lagging small currents.

(5) Leading small current interrupting capability

The vacuum interrupter of the first embodiment of the present invention interrupted two times a charging current of the conventional vacuum interrupter of condenser or unload line.

Figure 5:
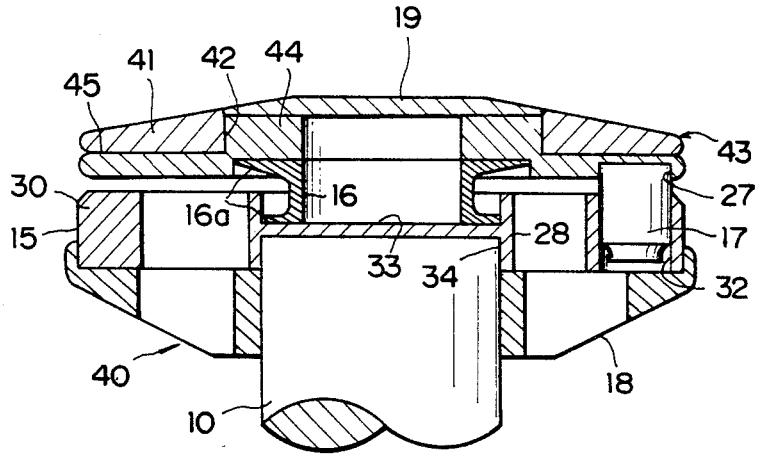
FIG. 5 is a sectional view through an electrode assembly modified from the movable one of FIG. 2.

FIG. 5 shows an electrode assembly 40 of a modification to the first embodiment of the present invention.

The electrode assembly 40 structurally differs from the movable electrode assembly 6 of FIG. 2 in the aspect that it includes a contact-electrode 43 consisting of an arc-diffusing portion 41 including a centrally located circular hole 42 and a contact-making portion 19 of FIG. 4 fitted into the hole 42, and an electrical lead member 45 for a coil-electode including a annular hub 44. In this case, an axial length of the spacer 16 may be increased. A surface of the hub 44 is electrically and mechanically joined by brazing to the backsurface of the contact-making portion 19. On the other hand, a periphery of the hub 44 is electrically and mechanically joined by brazing to a wall defining the hole 42. The electrode assembly 40 advantageously makes the electrical resistance between the contact-making portion 19 and the electrical lead member 45 for the coil-electrode, smaller than that of the same current path of the electrode assembly 6 of FIG. 2.

Figure 6:
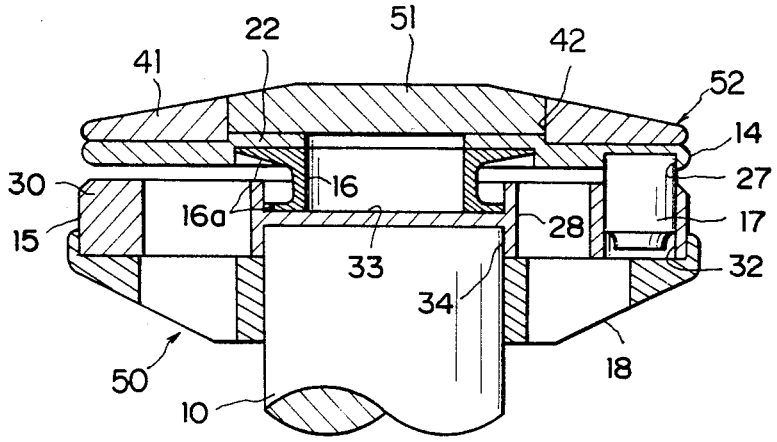
FIG. 6 is a sectional view through another electrode assembly modified from the movable one of FIG. 2.

FIG. 6 shows an electrode assembly 50 of another modification to the first embodiment of the present invention. The electrode assembly 50 structurally differs from the movable electrode assembly 6 of FIG. 2 in that it includes a contact-electrode 52 consisting of an arc-diffusing portion 41 of FIG. 5 and a contact-making portion 51 thickened and fitted into the hole 42 of the arc-diffusing portion 41. A backsurface of the contact-making portion 51 is electrically and mechanically joined by brazing to the hub 22 of an electrical lead member 14 for a coil-electrode of FIG. 2. On the other hand, a periphery of the contact-making portion 51 is electrically and mechanically joined by brazing to a wall difining the hole 42. The electrode assembly 50 has the same advantages as that of the electrode assembly 40 of FIG. 5.

According to the first embodiment and the modifications thereto, the coil-electrodes for applying an axial magnetic field are each provided behind each coil-electrode. The present invention is also applicable to such vacuum interrupter that includes means for applying an axial magnetic field outside its vacuum envelope (refer to U.S. Pat. No. 3,283,103), such as one that includes a coil for applying an axial magnetic field one end of which is directly connected to the backsurface of a contact-electrode (refer to U.S. Pat. No. 3,935,406) and such as one that includes a coil for applying an axial magnetic field located surrounding a pair of contact-electrodes (refer to GB No. 1,264,490A).

The present invention is further applicable to such vacuum interrupter that includes a contact-electrode consisting of a flat arc-diffusing portion and a contact-making portion projecting from a surface of the arc-diffusing portion at the central portion of the surface thereof.

Other embodiments of the present invention will be described hereinafter in which changes were made to materials of the contact-making portion 19 and the arc-diffusing portion 20 of the pair of stationary and movable contact-electrodes 24 and 13.

FIGS. 7A to 7D, FIGS. 8A to 8D and FIGS. 9A to 9D show structures of complex metals constituting arc-diffusing portions according to the 2nd to 10th embodiments of the present invention.

According to the 2nd to 10th embodiments of the present invention, arc-diffusing portion 20 is made of material of 5 to 30% IACS electrical conductivity, at least 30 kgf/mm$^2$ (294 MPa) tensile strength and 100 to 170 Hv hardness (hereinafter, under a lod of 1 kgf (9.81N)), e.g., complex metal consisting of 20 to 70% copper by weight, 5 to 40% chromium by weight and 5 to 40% iron by weight. A process for producing the complex metal may be generally classified into two categories. A process of one category comprises a step of diffusion-bonding a powder mixture consisting of chromium powder and iron powder into a porous matrix and a step of infiltrating the porous matrix with molten copper (hereinafter, referred to as an infiltration process). A process of the other category comprises a step of press-shaping a powder mixture consisting of copper powder, chromium powder and iron powder into a green compact and a step of sintering the green compact below the melting point of copper (about 1083° C.) or at at least the melting point of copper but below the melting point of iron (about 1537° C.) (hereinafter, referred to as a sintering process). The infiltration and sintering processes will be described hereinafter. Each metal powder was of minus 100 meshes.

THE FIRST INFILTRATION PROCESS

Firstly, a predetermined amount (e.g., an amount of one final contact-electrode plus a machining margin) of chromium powder and iron powder which are respectively prepared 5 to 40% by weight and 5 to 40% by weight but in total 30 to 80% by weight at a final ratio, are mechanically and uniformly mixed.

Secondly, the resultant powder mixture is placed in a vessel of a circular section made of material, e.g., alumina ceramics, which interacts with none of chromium, iron and copper. A solid copper is placed on the powder mixture.

Thirdly, the powder mixture and the solid copper are heat held under a nonoxidizing atmosphere, e.g., a vacuum pressure of at highest $5\times10^{-5}$ Torr (6.67 mPa) at 1000° C. for 10 min (hereinafter, referred to as a chromium-iron diffusion step), thus resulting in a porous matrix of chromium and iron. Then, the resultant porous matrix and the solid copper are heat held under the same vacuum at 1100° C. for 10 min, which leads to infiltrate the porous matrix with molten copper (hereinafter, referred to as a copper infiltrating step). After cooling, a desired complex metal for the arc-diffusing portion is produced.

THE SECOND INFILTRATION PROCESS

At first, chromium powder and iron powder are mechanically and uniformly mixed in the same manner as in the first infiltration process.

Secondly, the resultant powder mixture is placed in the same vessel as that in the first infiltration process. The powder mixture is heat held in a nonoxidizing atmosphere, e.g., a vacuum pressure of at highest $5\times10^{-5}$ Torr (6.67 mPa), or hydrogen, nitrogen or argon gas at a temperature below the melting point of iron, e.g., within 600° to 1000° C. for a fixed period of time, e.g., within 5 to 60 min, thus resulting in a porous matrix consisting of chromium and iron.

Thirdly, in the same nonoxidizing atmosphere, e.g., a vacuum pressure of at highest $5\times10^{-5}$ Torr (6.67 mPa), as that of the chromium-iron diffusion step, or other nonoxidizing atmosphere, a solid copper is placed on the porous matrix, then the porous matrix and the solid copper are heat held at a temperature of at least the melting point of copper but below a melting point of the porous matrix, e.g., 1100° C. for about a period of time of 5 to 20 min, which leads to infiltrate the porous matrix with molten copper. After cooling, a desired complex metal for the arc-diffusing portion is produced.

In the second infiltration process, a solid copper is not placed in the vessel in the chromium-iron diffusion step, so that a powder mixture of chromium powder and iron powder can be heat held to a porous matrix at a temperature of at least the melting point (1083° C.) of copper but below the melting point (1537° C.) of iron.

As an alternative in the second infiltration process, the chromium-iron diffusion step may be performed in various nonoxidizing atmosphere, e.g., hydrogen, nitrogen or argon gas, and the copper infiltration step may be performed under an evacuation to vacuum degassing the complex metal for the arc-diffusing portion.

In both the infiltration processes, vacuum is preferably selected as a nonoxidizing atmosphere, but not other nonoxidizing atmosphere, because degassing of the complex metal for the arc-diffusing portion can be concurrently performed during heat holding. However, even if a deoxidizing gas or an inert gas is used as a nonoxidizing atmosphere, the resultant is satisfactory for producing the complex metal for the arc-diffusing portion.

In addition, a heat holding temperature and period of time for the chromium-iron diffusion step is determined on a basis of taking into account conditions of the vacuum furnace or other gas furnace, the shape and size of a porous matrix and workability so that desired properties as those of a complex metal for the arc-diffusing portion will be produced. For example, a heating temperature of 600° C. determines a heat holding period of 60 min or a heating temperature of 1000° C. determines a heat holding period of 5 min.

The particle size of chromium particles and iron particles may be minus 60 meshes, i.e., no more than 250 μm. However, the lower an upper limit of the particle size, generally the more difficult to uniformly distribute each metal particle. Further, it is more complicated to handle the metal particles and they, when used, necessitate a pretreatment because they are more liable to be oxidized.

On the other hand, if the particle size of each metal article exceeds 60 meshes, it is necessary to make the heat holding temperature higher or to make the heat holding period of a time longer with a diffusion distance of each metal particle increasing, which leads to lowering in productivity of the chromium-iron diffusion step. Consequently, the upper limit of the particle size of each metal particle is determined in view of various conditions.

According to both infiltration processes, it is because the particles of chromium and iron can be more uniformly distributed to cause better diffusion bonding thereof, thus resulting in a complex metal for the arc-diffusing portion possessing better properties, that the particle size of each metal particle is determined to be minus 100 meshes. If chromium particles and iron particles are badly distributed, then drawbacks of both metals will not be offset by each other and advantages thereof will not be developed. In particular, the more the particle size of each metal particle exceeds 60 meshes, the larger is the proportion of copper in the surface region of an arc-diffusing portion, which contributes to lowering the dielectric strength of the contact-electrode. Similarly chromium particles, iron particles and chromium-rion alloy particles have been large granulations are more likely to appear in the surface region of the arc-diffusing portion, so that drawbacks of respective chromium, iron and copper are more apparent.

THE SINTERING PROCESS

At first, chromium powder, iron powder and copper powder which are prepared in the same manner as in the first infiltration process are mechanically and uniformly mixed.

Secondly, the resultant powder mixture is placed in a preset vessel and press-shaped into a green compact under a preset pressure, e.g., of 2,000 to 5,000 kgf/cm$^2$ (196.1 to 490.4 MPa).

Thirdly, the resultant green compact which is taken out of the vessel is heat held in a nonoxidizing atmosphere, e.g., a vacuum pressure of at highest $5\times10^{-5}$ Torr (6.67 MPa), or hydrogen, nitrogen or argon gas at a temperature below the melting point of copper, e.g., at 1000° C., or at a temperature of at least the melting point of copper but below the melting point of iron, e.g., at 1100° C. for a preset period of time, e.g., within 5 to 60 min, thus being sintered into the complex metal of the arc-diffusing portion.

In the sintering process, conditions of the nonoxidizing atmosphere and the particle size of each metal particle are the same as those in both the infiltration processes, and conditions of the heat holding temperature and the heat holding period of time required for sintering the green compact are the same as those for producing the porous matrix from the powder mixture of metal powders in the infiltration processes.

Referred to FIGS. 7A to 7D, FIGS. 8A to 8D and FIGS. 9A to 9D which are photographs by the X-ray microanalyzer, structures of the complex metals for the arc-diffusing portion 20 which are produced according to the first infiltration process above, will be described hereinafter.

Example $A_1$ of the complex metal for the arc-diffusing portion possesses a composition consisting of 50% copper by weight, 10% chromium by weight and 40% iron by weight.

Figure 7A:
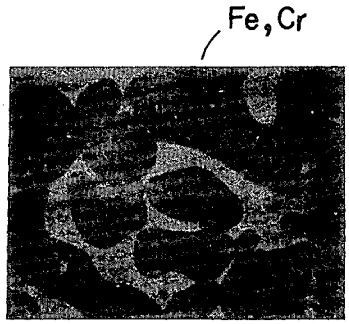
Figure 7B:
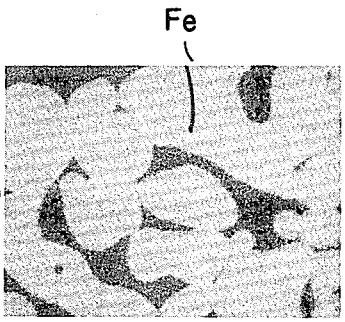
Figure 7C:
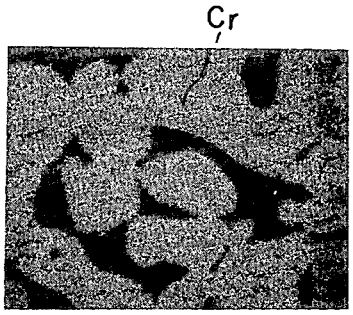
Figure 7D:
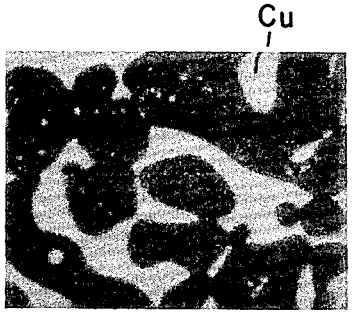
Figure 8A:
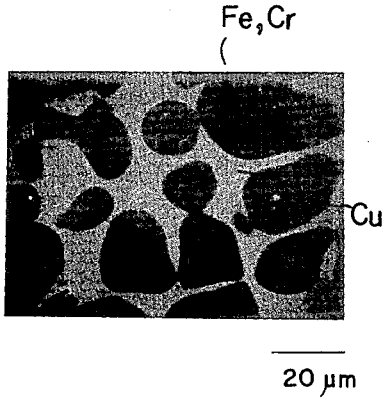
Figure 8B:
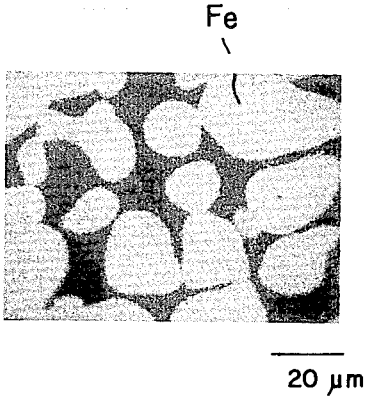
Figure 8C:
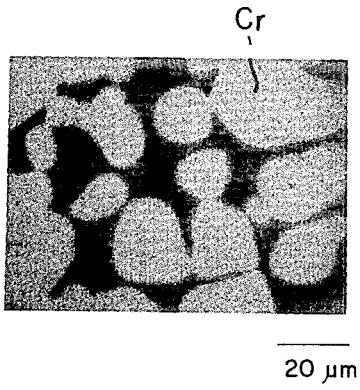
Figure 8D:
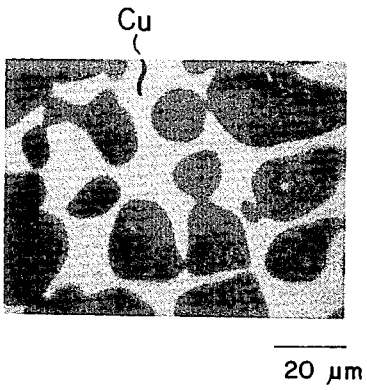
Figure 9A:
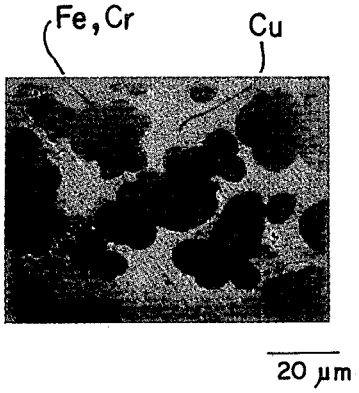
Figure 9B:
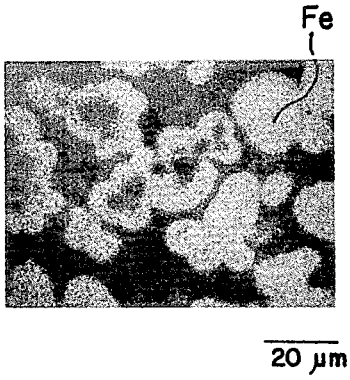
Figure 9C:
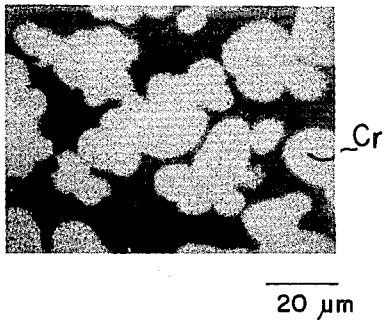
Figure 9D:
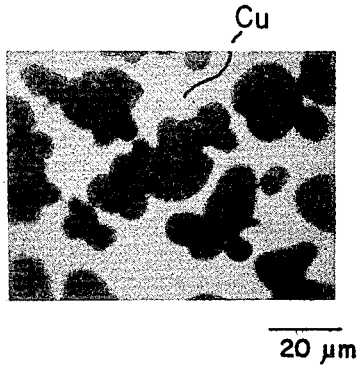

FIG. 7A shows a secondary electron image of a metal structure of Example $A_1$. FIG. 7B shows a characteristic X-ray image of distributed and diffused iron, in which distributed white or gray insular agglomerates indicate iron. FIG. 7C shows a characteristic X-ray image of distributed and diffused chromium, in which distributed gray insular agglomerates indicate chromium. FIG. 7D shows a characteristic X-ray image of infiltrant copper, in which white parts indicate copper.

Example $A_2$ of the complex metal for the arc-diffusing portion possesses a composition consisting of 50% copper by weight, 25% chromium by weight and 25% iron by weight.

FIGS. 8A, 8B, 8C and 8D show similar images to those of FIGS. 7A, 7B, 7C and 7D, respectively.

Example $A_3$ of the complex metal for the arc-diffusing portion possesses a composition of consisting of 50% copper by weight, 40% chromium by weight and 10% iron by weight.

FIGS. 9A, 9B, 9C and 9D show similar images to those of FIGS. 7A, 7B, 7C and 7D, respectively.

As apparent from FIGS. 7A to 7D, FIGS. 8A to 8D and FIGS. 9A to 9D, the chromium and the iron are uniformly distributed and diffused into each other in the metal structure, thus forming many insular agglomerates. The agglomerates are uniformly bonded to each other throughout the metal structure, resulting in the porous matrix consisting of chromium and iron. Interstices of the porous matrix are infiltrated with copper, which results in a stout structure of the complex metal for the arc-diffusing portion.

FIGS. 10A to 10D, FIGS. 11A to 11D and FIGS. 12A to 12D show structures of complex metals for the contact-making portion 19 according to the 2nd to 10th embodiments of the present invention.

According to the 2nd to 10th embodiments of the present invention, the contact-making portion 19 is made of material of 20 to 60% IACS electrical conductivity and 120 to 180 Hv hardness, e.g., complex metal consisting of 20 to 70% copper by weight, 5 to 70% chromium by weight and 5 to 70% molybdenum by weight. The complex metals for the contact-making portion are produced substantially by the same processes as those for producing the arc-diffusing portion.

Referred to FIGS. 10A to 10D, FIGS. 11A to 11D and FIGS. 12A to 12D which are photographs by the X-ray microanalyzer as well as FIGS. 7A to 7D, structures of the complex metals for the contact-making portion which are produced according to substantially the same process as the first infiltration process above, will be described hereinafter.

Example $C_1$ of the complex metal for the contact-making portion possesses a composition consisting of 50% copper by weight, 10% chromium by weight and 40% molybdenum by weight.

Figure 10A:
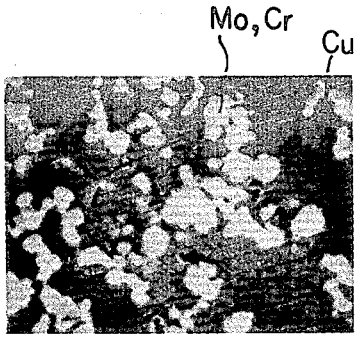
Figure 10B:
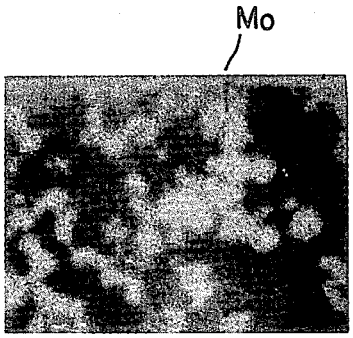
Figure 10C:
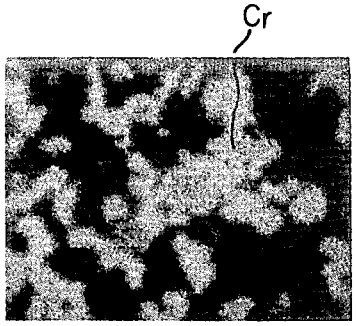
Figure 10D:
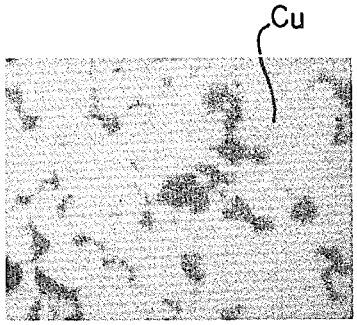
Figure 11A:
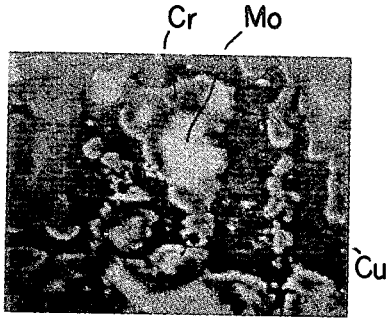
Figure 11B:
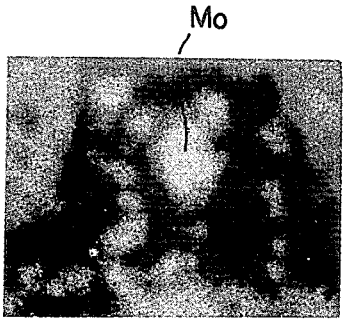
Figure 11C:
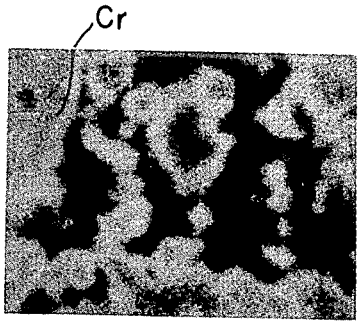
Figure 11D:
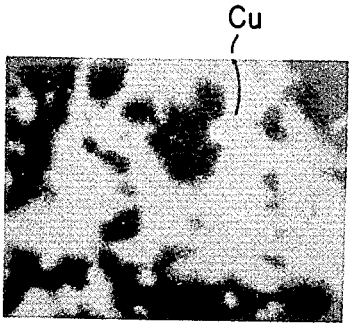
Figure 12A:
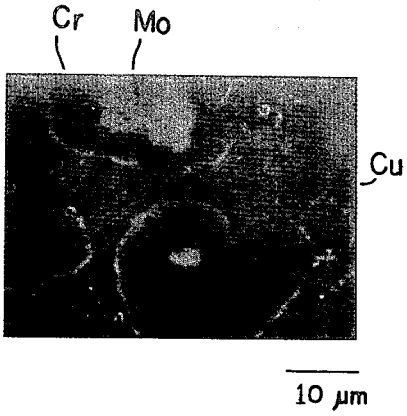
Figure 12B:
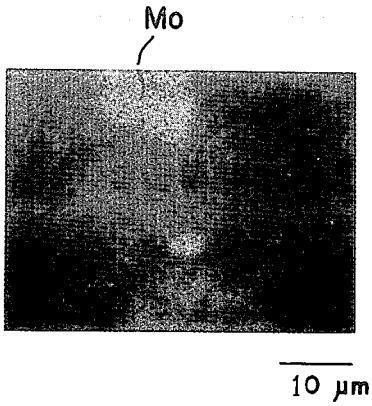
Figure 12C:
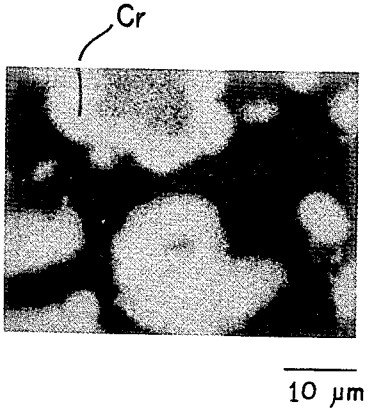
Figure 12D:
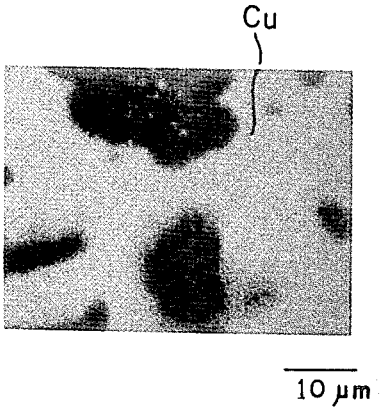

FIG. 10A shows a secondary electron image of a metal structure of Example $C_1$. FIG. 10B shows a characteristic X-ray image of distributed and diffused molybdenum, in which distributed gray insular agglomerates indicate molybdenum. FIG. 10C shows a characteristic X-ray image of distributed and diffused chromium, in which distributed gray or white insular agglomerates indicate chromium. FIG. 10D shows a characteristic X-ray image of infiltrant copper, in which white parts indicate copper.

Example $C_2$ of the complex metal for the contact-making portion possesses a composition consisting of 50% copper by weight, 25% chromium by weight and 25% molybdenum by weight.

FIGS. 11A, 11B, 11C and 11D show similar images to those of FIGS. 10A, 10B, 10C and 10D, respectively.

Example $C_3$ of the complex metal for the contact-making portion possesses a composition consisting of 50% copper by weight, 40% chromium by weight and 10% molybdenum by weight.

FIGS. 12A, 12B, 12C and 12D show similar images to those of FIGS. 10A, 10B, 10C and 10D, respectively.

As apparent from FIGS. 10A to 10D, FIGS. 11A to 11D and FIGS. 12A to 12D, the chromium and molybdenum are uniformly distributed and diffused into each other in the metal structure, thus forming many insular agglomerates. The agglomerates are uniformly bonded to each other throughout the metal structure, thus resulting in the porous matrix consisting of chromium and molybdenum. Interstices of the porous matrix are infiltrated with copper, which results in a stout structure of the complex metal for the contact-making portion.

Measurements of IACS electrical conductivity which were carried out on Examples $A_1$, $A_2$ and $A_3$ of the complex metal for the arc-diffusing portion established that they possessed 8 to 10% IACS electrical conductivity, at least 30 kgf/mm$^2$ (294 MPa) tensile strength and 100 to 170 Hv hardness.

On the other hand, tests established that Examples $C_1$, $C_2$ and $C_3$ possessed 40 to 50% IACS electrical conductivity and 120 to 180 Hv hardness.

The contact-making portion of a 1st comparative is made of 20Cu-80W alloy. The contact-making portion of a 2nd comparative is made of Cu-0.5Bi alloy.

Examples $A_1$, $A_2$ and $A_3$ of the complex metal for the arc-diffusing portion and Examples $C_1$, $C_2$ and $C_3$ of the complex metal for the contact-making portion, which are shown and described above, were shaped to substantially thinned frustrums of circular cone having 100 mm and 60 mm diameters respectively, as shown in FIGS. 2 and 3. Examples $A_1$, $A_2$, $A_3$, $C_1$, $C_2$ and $C_3$, and a 20Cu-80W alloy and a Cu-0.5Bi alloy were all paired off, resulting in eleven contact-electrodes. A pair of contact-electrodes made up in the above manner was assembled into a vacuum interrupter of the axial magnetic field applying type as illustrated in FIG. 1. Tests were carried out on performances of this vacuum interrupter. The results of the tests will described hereinafter. A description shall be made on a vacuum interrupter of the 5th embodiment of the present invention which includes the pair of contact-electrodes each consisting of the arc-diffusing portion made of Example $A_2$, and the contact-making portion made of Example $C_1$. An arc-diffusing portion and a contact-making portion of a contact-electrode of a 2nd embodiment are made of respective Examples $A_1$ and $C_1$. Those of a 3rd, of Examples $A_1$ and $C_2$. Those of a 4th, of Examples $A_1$ and $C_3$. Those of a 6th, of Examples $A_2$ and $C_2$. Those of a 7th, of Examples $A_2$ and $C_3$. Those of a 8th, of Examples $A_3$ and $C_1$. Those of a 9th, of Examples $A_3$ and $C_2$. Those of 10th, of Examples $A_3$ and $C_3$.

When performances of the vacuum interrupters of the 2nd to 4th and 6th to 10th embodiments of the present invention differ from those of the 5th embodiment of the present invention, then different points shall be specified.

(6) Large current interrupting capability

Interruption tests which were carried out at an opening speed within 1.2 to 1.5 m/s under a rated voltage of 12 kV, however, a transient recovery voltage of 21 kV according to JEC-181, established that the test vacuum interrupters interrupted 60 kA current. Moreover, interruption tests at an opening speed of 3.0 m/s under a rated voltage of 84 kV, however, a transient recovery voltage of 143 kV according to JEC-181, established that the test vacuum interrupters interrupted 49 kA current.

Table 1 below shows the results of the large current interrupting capability tests. Table 1 also shows those of vacuum interrupters of 1st to 8th comparative which include a pair of contact-electrodes each consisting of an arc-diffusing portion and a contact-making portion. The portions have the same sizes as those of the respective arc-diffusing portion and contact-making portion of the 2nd to 10th embodiments of the present invention.

An arc-diffusing portion and a contact-making portion of a contact-electrode of the 1st comparative are made of Example $A_2$ and 20Cu-80W alloy. Those of 2nd comparative, of Example $A_2$ and Cu-0.5Bi alloy. Those of the 3rd comparative, of copper disc and Example $C_1$. Those of the 4th comparative, of copper disc and 20Cu-80W alloy. Those of the 5th comparative, of copper disc and Cu-0.5Bi alloy. Those of the 6th comparative, of 6-radially slitted copper disc and Example $C_1$. Those of 7th comparative, of copper disc of the same type of the 6th comparative and 20Cu-80W alloy. Those of the 8th comparative, of copper disc of the same type of the 6th comparative and Cu-0.5Bi alloy.

Vacuum interrupters of the axial magnetic field applying type of the 3rd to 8th comparatives each are of a type in which an outer periphery of a backsurface of an arc-diffusing portion and a distal end of a partial turning segment of a coil-electrode are connected to each other by means of an electrical connector (refer to U.S. Pat. No. 3,946,179).

TABLE 1

| Embodiment | Contact-electrode: Arc-diffusing Portion | Contact-electrode: Contact-making Portion | Large Current Interrupting Capability 12 kV | Large Current Interrupting Capability 84 kV | Rated Load Current Switching Durability at 84 kV Times |
|---|---|---|---|---|---|
| No. 2 | Example $A_1$ | Example $C_1$ | 56 | 47 | 10000 |
| 3 | Example $A_1$ | Example $C_2$ | 56 | 47 | " |
| 4 | Example $A_1$ | Example $C_3$ | 58 | 46 | " |
| 5 | Example $A_2$ | Example $C_1$ | 60 | 49 | " |
| 6 | Example $A_2$ | Example $C_2$ | 60 | 49 | " |
| 7 | Example $A_2$ | Example $C_3$ | 59 | 50 | " |
| 8 | Example $A_3$ | Example $C_1$ | 56 | 48 | " |
| 9 | Example $A_3$ | Example $C_2$ | 56 | 47 | " |
| 10 | Example $A_3$ | Example $C_3$ | 58 | 48 | " |
| Comparative 1 | Example $A_2$ | 20Cu—80W | 40 | 30 | " |
| 2 | Example $A_2$ | Cu—0.5Bi | 50 | 30 | " |
| 3 | copper disc | Example $C_1$ | 22 | 12 | " |
| 4 | copper disc | 20Cu—80W | 20 | 10 | " |
| 5 | copper disc | Cu—0.5Bi | 20 | 10 | " |
| 6 | copper disc with 6 slits | Example $C_1$ | 46 | 35 | 500 |
| 7 | copper disc with 6 slits | 20Cu—80W | 36 | 25 | " |
| 8 | copper disc with 6 slits | Cu—0.5Bi | 47 | 28 | " |

(7) Dielectric strength

In accordance with JEC-181 test method, impulse withstand voltage tests were carried out with a 3.0 mm inter-connect gap. The vacuum interrupters showed 120 kV withstand voltage against both positive and negative impulses with a ±10 kV deviation.

After 10 times interruping 60 kA current of rated 12 kV, the same impulse withstand voltage tests were carried out, thus establishing the same results.

After continuously 100 times opening and closing a circuit through which 80 A leading small current of rated 12 kV flowed, the same impulse withstand voltage tests were carried out, thus establishing substantially the same results.

Table 2 below shows the results of the tests of the impulse withstand voltage at rated 84 kV which were carried out on the vacuum interrupters of the 5th embodiment. Table 2 also shows those of the vacuum interrupters of the 1st to 8th comparatives.

TABLE 2

| Embodiment | Contact-electrode: Arc-diffusing Portion | Contact-electrode: Contact-making Portion | Withstand Voltage kV |
|---|---|---|---|
| No. 5 | Example $A_2$ | Example $C_1$ | ±400 |
| Comparative 1 | " | 20Cu—80W | ±300 |
| 2 | " | Cu—0.5Bi | ±250 |
| 3 | copper disc | Example $C_1$ | ±250 |
| 4 | " | 20Cu—80W | ±250 |
| 5 | " | Cu—0.5Bi | ±200 |
| 6 | copper disc with 6 slits | Example $C_1$ | ±150 |
| 7 | copper disc with 6 slits | 20Cu—80W | ±180 |
| 8 | copper disc with 6 slits | Cu—0.5Bi | ±150 |

(8) Anti-welding capability

In accordance with the IEC rated short time current, current of 25 kA was flowed through the stationary and movable contact-electrodes 24 and 13 which were forced to contact each other under 130 kgf (1275N) force, for 3 s. The stationary and movable contact-electrodes 24 and 13 were then separated without any failures with a 200 kgf (1961N) static separating force. An increase of electrical contact resistance was then limited to within 2 to 8%.

In accordance with the IEC rated short time current, current of 50 kA was flowed through the stationary and movable contact-electrodes 5 and 6 which were forced into contact each other under 1,000 kgf (9807N) force, for 3 s. The stationary and movable contact-electrodes 24 and 13 were then separated without any failures with a 200 kgf (1961N) static separating force. An increase in electrical contact resistance was limited to no more than 5%. Thus, the stationary and movable contact-electrodes 24 and 13 actually possess good anti-welding capability.

(9) Lagging small current interrupting capability

In accordance with a lagging small current interrupting test of JEC-181, a 30 A test current of $$84 \times \frac{1.5}{\sqrt{3}} \text{ kV}$$

was flowed through the stationary and movable contact-electrodes 24 and 13. Current chopping values had a 3.9 A average (however, a standard deviation $\sigma_n = 0.96$ and a sample number $n = 100$).

In particular, current chopping values of the vacuum interrupters of the 6th and 7th embodiments of the present invention were respective 3.7 A (however, $\sigma_n = 1.26$ and $n = 100$) and 3.9 A (however, $\sigma_n = 1.5$ and $n = 100$) averages.

(10) Leading small current interrupting capability

In accordance with a leading small current interrupting test standard of JEC-181, a test leading small current of 80 A at $$84 \times \frac{1.25}{\sqrt{3}} \text{ kV}$$

was flowed through the stationary and movable contact-electrodes 24 and 13. Under that condition a continuously 10,000 times opening and closing test was carried out. No reignition was established.

The following limits were apparent on a composition ratio of each metal in the complex metal for the arc-diffusing portion.

Copper below 20% by weight significantly lowered current interrupting capability. On the other hand, copper above 70% by weight significantly lowered the mechanical and dielectric strengths of the arc-diffusing portion but increased the electrical conductivity thereof, thus significantly lowering the current interrupting capability.

Chromium below 5% by weight increased the electrical conductivity of the arc-diffusing portion, thus significantly lowering the current interrupting capability and dielectric strength. On the other hand, chromium above 40% by weight significantly lowered the mechanical strength of the arc-diffusing portion.

Iron below 5% by weight significantly lowered the mechanical strength of the arc-diffusing portion. On the other hand, iron above 40% by weight significantly lowered the current interrupting capability.

The following limits were apparent on a composition ratio of each metal in the complex metal for the contact-making portion.

Copper below 20% by weight significantly lowered the electrical conductivity of the contact-making portion but significantly increased the electrical contact resistance thereof. On the other hand, copper above 70% by weight significantly increased the current chopping value but significantly lowered the anti-welding capability and dielectric strength.

Chromium below 5% by weight significantly lowered the dielectric strength. On the other hand, chromium above 70% by weight significantly decreased the electrical conductivity and mechanical strength of the contact-making portion.

Molybdenum below 5% by weight significantly lowered the dielectric strength. On the other hand, molybdenum above 70% by weight significantly lowered the mechanical strength of the contact-making portion but significantly increased the current chopping value.

According to the second to 10th embodiments of the present invention, the increased tensile strength of the arc-diffusing portion significantly decreases a thickness and weight of the contact-making portion and considerably improves the durability of the contact-making portion.

According to them, decreased the electrical conductivity of the arc-diffusing portion significantly decreases amount of eddy current, thus obviating the need for any slit to considerably increase the mechanical strength of the contact-electrode.

Accordingly, the arc-diffusing portion and the contact-making portion are prevented from excessively melting, thus resulting in a significantly decreased erosion of both portions, because the arc-diffusing portion is made of complex metal of high hardness and including uniformly distributed constituents, and because the arc-diffusing portion includes no slit.

Thus, the recovery voltage characteristic is improved and there is little lowering of dielectric strength even after many interruptions. For example, lowering of the dielectric strength after 10,000 interruptions amounts to 10 to 20% of dielectric strength before interruption, thus decreasing current chopping value too.

FIGS. 13A to 13D and FIGS. 14A to 14D show structures of complex metals for the arc-diffusing portion.

According to 11th and 28th embodiments of the present invention, arc-diffusing portions 20 are made of complex metal consisting of 30 to 70% magnetic stainless steel by weight and 30 to 70% copper by weight. For example, ferritic stainless and martensitic stainless steels are used as a magnetic stainless steel. As a ferritic stainless steel, SUS405, SUS429, SUS430, SUS430F and SUS405 may be listed up. As a martensitic stainless steel, SUS403, SUS410, SUS416, SUS420, SUS431 and SUS440C may be listed up.

The complex metal above consisting of 30 to 70% magnetic stainless steel by weight and 30 to 70% copper by weight, possesses at least 30 kgf/mm$^2$ (294 MPa) tensile strength and 100 to 180 Hv hardness. This complex metal possesses 3 to 30% IACS electrical conductivity when a ferritic stainless steel used, while 4 to 30% IACS electrical conductivity when a martensitic stainless steel used.

Complex metals for the arc-diffusing portion 20 of the 11th to 28th embodiments of the present invention were produced by substantially the same as the first infiltration process.

Contact-making portions 19 of contact-electrodes of the 11th to 28th embodiments of the present invention are made of the same complex metals as those for the contact-making portions of contact-electrodes of the 2nd to 10th embodiments of the present invention.

Contact-making portions of contact electrodes of the 9th and 10th comparatives of the present invention are made of Cu-0.5Bi alloy. Contact-making portions of contact-electrodes of the 11th and 12th comparatives of the present invention are made of 20Cu-80W alloy.

Referred to FIGS. 13A to 13D and FIGS. 14A to 14D which are photographs by the X-ray microanalyzer, structures of the complex metals for the arc-diffusing portion which were produced according to substantially the same process as the first infiltration process, will be described hereinafter.

Example $A_4$ of a complex metal for the arc-diffusing portion possesses a composition consisting of a 50% ferritic stainless steel SUS434 by weight and 50% copper by weight.

Figure 13A:
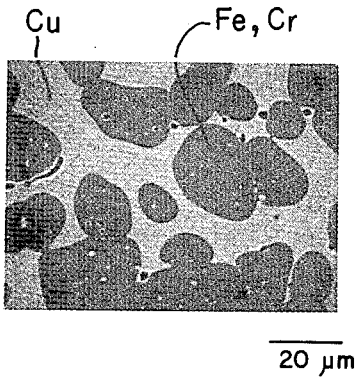
Figure 13B:
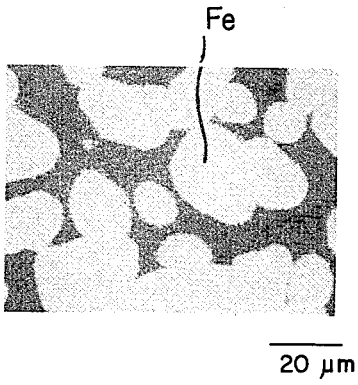
Figure 13C:
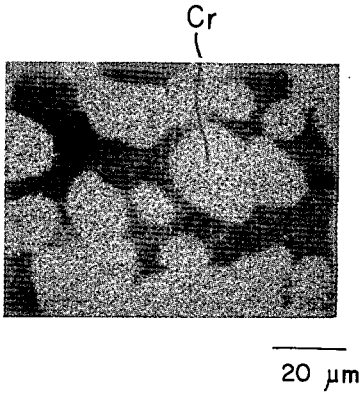
Figure 13D:
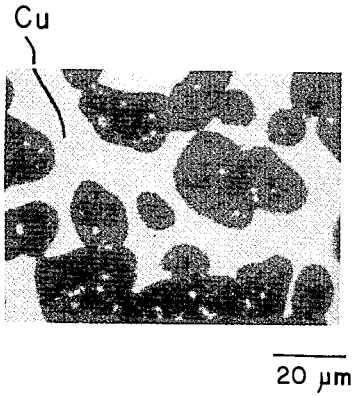
Figure 14A:
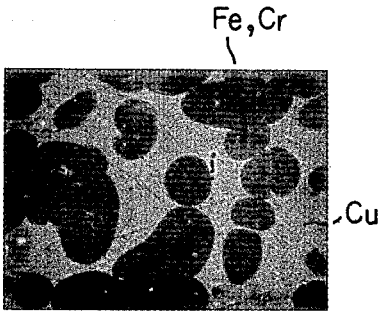
Figure 14B:
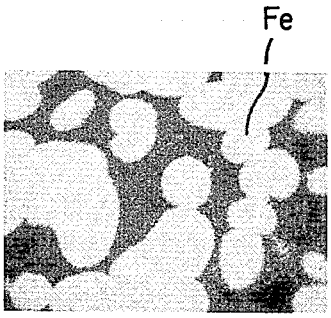
Figure 14C:
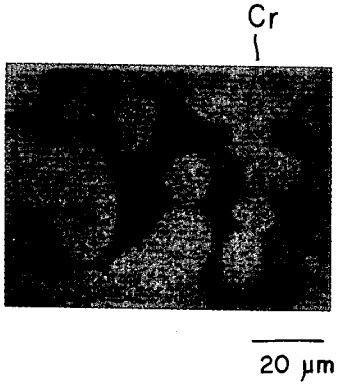
Figure 14D:
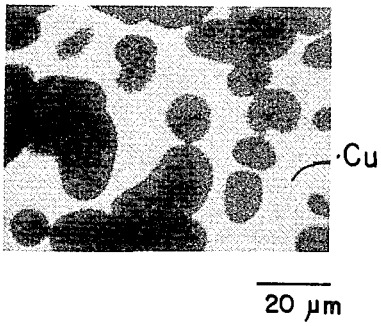

FIG. 13A shows a secondary electron image of a metal structure of Example $A_4$. FIG. 13B shows a characteristic X-ray image of distributed iron, in which distributed white insular agglomerates indicate iron. FIG. 13C shows a characteristic X-ray image of distributed chromium, in which distributed gray insular agglomerates indicate chromium. FIG. 13D shows a characteristic X-ray image of infiltrant copper, in which white parts indicate copper.

As apparent from FIGS. 13A to 13D, the particles of ferritic stainless steel SUS434 are bonded to each other, resulting in a porous matrix. Interstices of the porous matrix are infiltrated with copper, which results in a stout structure of the complex metal for the arc-diffusing portion.

Example $A_7$ of the complex metal for the arc-diffusing portion possesses a composition consisting of a 50% martensitic stainless steel SUS410 by weight and 50% copper by weight.

FIGS. 14A, 14B, 14C and 14D show similar images to those of FIGS. 13A, 13B, 13C and 13D, respectively.

Structures of complex metals of FIGS. 14A to 14D are similar to those of FIGS. 13A to 13D.

Example $A_5$ of the complex metal for the arc-diffusing portion possesses a composition consisting of a 70% ferritic stainless steel SUS434 by weight and 30% copper by weight. Example $A_6$, 30% ferritic stainless steel SUS434 by weight and 70% copper by weight. Example $A_8$, 70% martensitic stainless steel SUS410 by weight and 30% copper by weight. Example $A_9$, 30% martensitic stainless steel SUS410 by weight and 70% copper by weight.

Examples $A_5$, $A_6$, $A_8$ and $A_9$ of the complex metal for the arc-diffusing portion were produced by substantially the same as the first infiltration process.

Measurements of IACS electrical conductivity which were carried out on Examples $A_4$ to $A_9$ of the complex metal for the arc-diffusing portion and Examples $C_1$ to $C_3$ above the complex metal for the contact-making portion established that:

Example $A_4$, 5 to 15% IACS electrical conductivity
Example $A_5$, 3 to 8%
Example $A_6$, 10 to 30%
Example $A_7$, 5 to 15%
Example $A_8$, 4 to 8%
Example $A_9$, 10 to 30%
Example $C_1$, 40 to 50%
Example $C_2$, 40 to 50%
Example $C_3$, 40 to 50%.

Respective measurements of tensile strength and hardness established that Example $A_4$ of the complex metal for the arc-diffusing portion possessed 30 kgf/mm$^2$ (294 MPa) tensile strength and 100 to 180 Hv hardness.

Examples $A_4$ to $A_9$ of the complex metal for the arc-diffusing portion 20 and Examples $C_1$ to $C_3$ of the complex metal for the contact-making portion 19 are respectively shaped to the same shapes as those of the arc-diffusing portion and the contact-making portion of the 2nd to 10th embodiments of the present invention, and tested as a pair of contact-electrodes in the same manner as in the 2nd and 10th embodiments of the present invention. Results of the test will be described hereinafter. A description shall be made on a vacuum interrupter of the 11th embodiment of the present invention which includes the pair of contact-electrodes each consisting of the arc-diffusing portion 20 made of Example $A_4$, and the contact-making portion 19 made of Example $C_1$. An arc-diffusing portion 20 and a contact-making portion 19 of a contact-electrode of a 12th embodiment are made of respective Examples $A_4$ and $C_2$. Those of a 13th, of Examples $A_4$ and $C_3$. Those of a 14th, of Examples $A_5$ and $C_1$. Those of a 15th, of Examples $A_5$ and $C_2$. Those of a 16th, of Examples $A_5$ and $C_3$. Those of a 17th, of Examples $A_6$ and $C_1$. Those of a 18th, of Examples $A_6$ and $C_2$. Those of a 19th, of Examples $A_6$ and $C_3$. Those of a 20th, of Examples $A_7$ and $C_1$. Those of a 21st, of Examples $A_7$ and $C_2$. Those of a 22nd, of Examples $A_4$ and $C_3$. Those of a 23rd, of Examples $A_8$ and $C_1$. Those of a 24th, sixth, of Examples $A_8$ and $C_2$. Those of a 25th, of Examples $A_8$ and $C_3$. Those of a 26th, of Examples $A_9$ and $C_1$. Those of a 27th, of Examples $A_9$ and $C_2$. Those of a 28th, of Examples $A_9$ and $C_3$. Those of a 9th comparative, of Example $A_4$ and Cu-0.5Bi alloy. Those of a 10th comparative, of Example $A_7$ and Cu-0.5Bi alloy. Those of a 11th comparative, of Example $A_4$ and 20Cu-80W alloy. Those of a 12th comparative, of Example $A_4$ and 20Cu-80W alloy.

When performances of the vacuum interrupters of the 12th to 28th embodiments of the present invention differ from those of the 11th embodiment of the present invention, then different points shall be specified.

(11) Large current interrupting capability

Interruption tests which were carried out at an opening speed within 1.2 to 1.5 m/s under a rated voltage of 12 kV, however, a transient recovery voltage of 21 kV according to JEC-181, established that the test vacuum interrupters interrupted, 63 kA current. Moreover, interruption tests at an opening speed of 3.0 m/s under a rated voltage of 84 kV, however, a transient recovery voltage of 143 kV according to JEC-181, established that the test vacuum interrupters interrupted 52 kA current.

Table 3 below shows the results of the large current interrupting capability tests.

TABLE 3

| Embodiment | Contact-electrode: Arc-diffusing Portion | Contact-electrode: Contact-making Portion | Large Current Interrupting Capability kA: 12 kV | Large Current Interrupting Capability kA: 84 kV | Rated Load Current Switching Durability at 84 kV Times |
|---|---|---|---|---|---|
| No. 11 | Example $A_4$ | Example $C_1$ | 63 | 52 | 10000 |
| 12 | Example $A_4$ | Example $C_2$ | 62 | 50 | " |
| 13 | Example $A_4$ | Example $C_3$ | 60 | 51 | " |
| 14 | Example $A_5$ | Example $C_1$ | 62 | 50 | " |
| 15 | Example $A_5$ | Example $C_2$ | 61 | 48 | " |
| 16 | Example $A_5$ | Example $C_3$ | 59 | 49 | " |
| 17 | Example $A_6$ | Example $C_1$ | 58 | 49 | " |
| 18 | Example $A_6$ | Example $C_2$ | 59 | 47 | " |
| 19 | Example $A_6$ | Example $C_3$ | 61 | 49 | " |
| 20 | Example $A_7$ | Example $C_1$ | 62 | 51 | " |
| 21 | Example $A_7$ | Example $C_2$ | 62 | 51 | " |
| 22 | Example $A_7$ | Example $C_3$ | 61 | 50 | " |
| 23 | Example $A_8$ | Example $C_1$ | 60 | 49 | " |
| 24 | Example $A_8$ | Example $C_2$ | 60 | 50 | " |
| 25 | Example $A_8$ | Example $C_3$ | 61 | 50 | " |
| 26 | Example $A_9$ | Example $C_1$ | 60 | 48 | " |
| 27 | Example $A_9$ | Example $C_2$ | 60 | 49 | " |
| 28 | Example $A_9$ | Example $C_3$ | 59 | 48 | " |
| Comparative 9 | Example $A_4$ | Cu—0.5Bi | 40 | 30 | " |
| 10 | Example $A_7$ | " | 40 | 30 | " |
| 11 | Example $A_4$ | 20Cu—80W | 40 | 30 | " |
| 12 | Example $A_7$ | " | 40 | 30 | " |

(12) Dielectric strength

In accordance with JEC-181 test method, impulse withstand voltage tests were carried out with a 30 mm inter-contact gap. The results showed 400 kV withstand voltage against both positive and negative impulses with a ±10 kV deviation.

After 10 times interrupting 63 kA current of rated 12 kV, the same impulse withstand voltage tests were carried out, thus establishing the same results.

After continuously 100 times opening and closing a circuit through which 80 A leading small current of rated 12 kV flowed, the same impulse withstand voltage tests were carried out, thus establishing substantially the same results.

Table 4 below shows the results of the tests of the impulse withstand voltage at rated 84 kV which were carried out on the vacuum interrupters of the 11th embodiment of the present invention, and the 9th to 12th comparatives.

TABLE 4

| Embodiment | | Contact-electrode Arc-diffusing Portion | Contact-electrode Contact-making Portion | Withstand Voltage kV |
|---|---|---|---|---|
| No. | 11 | Example $A_4$ | Example $C_1$ | ±400 |
| Comparative | 9 | " | Cu—0.5Bi | ±250 |
| | 10 | Example $A_7$ | " | ±250 |
| | 11 | Example $A_4$ | 20Cu—80W | ±400 |
| | 12 | " | " | ±400 |

(13) Anti-welding capability

The same as in item (8).

(14) Lagging small current interrupting capability

In accordance with a lagging small current interrupting test of JEC-181, a 30 A test current of $$84 \times \frac{1.5}{\sqrt{3}} \text{ kV}$$

was flowed through the stationary and movable contact-electrodes 24 and 13. Current shopping values had a 3.9 A average (however, a standard deviation $\sigma_n=0.96$ and a sample number $n=100$).

In particular, current chopping values of the vacuum interrupters of the 12th, 15th, 18th, 21st, 24th and 27th embodiments of the present invention had a 3.7 A (however, $\sigma_n=1.26$ and $n=100$) average, respectively, and current chopping values of the vacuum interrupters of the 13th, 16th, 19th, 22nd, 24th and 28th embodiments of the present invention had respective a 3.9 (however, $\sigma_n=1.5$ and $n=100$) average, respectively.

(15) Leading small current interrupting capability

The same as in item (10).

The following limits were apparent on a composition ratio of magnetic stainless steel in the complex metal for the arc-diffusing portion of the 11th to 28th embodiments of the present invention.

Magnetic stainless steel below 30% by weight significantly increased the electrical conductivity to generate large eddy currents but lowered the mechanical strength and durability of the arc-diffusing portion 20, so that the arc-diffusing portion 20 had to be thickened.

On the other hand, magnetic stainless steel above 70% by weight significantly lowered interruption performances.

The 11th to 28th embodiments of the present invention effect the same advantages as the 2nd to 10th embodiments of the present invention do.

FIGS. 15A to 15E show structures of the complex metals for the arc-diffusing portion 20 of the 29th to 37th embodiments of the present invention.

Arc-diffusing portions 20 of the 29th to 37th embodiments of the present invention are made of complex metal consisting of 30 to 70% austinitic stainless steel by weight and 30 to 70% copper by weight. As an austinitic stainless steel, SUS304, SUS304L, SUS316 or SUS316L may be, for example, used.

The complex metal consisting of 30 to 70% austinitic stainless steel by weight and 30 to 70% copper by weight possesses 4 to 30% IACS electrical conductivity, at least 30 kgf/mm$^2$ (294 MPa) tensile strength and 100 to 180 Hv hardness.

The complex metal for the arc-diffusing portion 20 of the 29th to 37th embodiments of the present invention were produced by substantially the same as the first infiltration process.

Contact-making portions 19 of the 29th to 37th embodiments of the present invention are made of complex metal of the same composition as that of the complex metal of the 2nd to 10th embodiments of the present invention.

Referred to FIGS. 15A to 15E which are photographs by the X-ray microanalyzer, structures of the complex metals for the arc-diffusing portion which were produced by substantially the same process as the first infiltration process, will be described hereinafter.

Example $A_{10}$ of a complex metal for the arc-diffusing portion possesses a composition consisting of 50% austinitic stainless steel SUS304 by weight and 50% copper by weight.

Figure 15A:
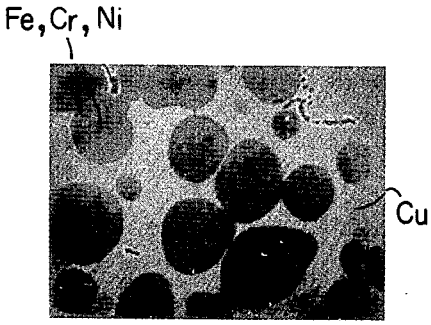
Figure 15B:
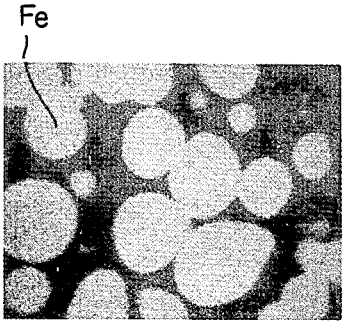
Figure 15C:
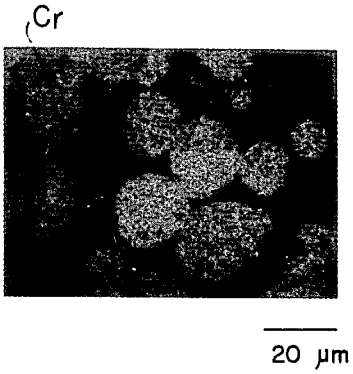
Figure 15D:
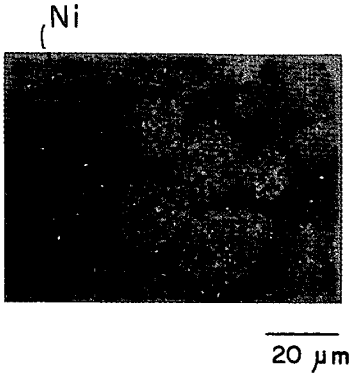
Figure 15E:
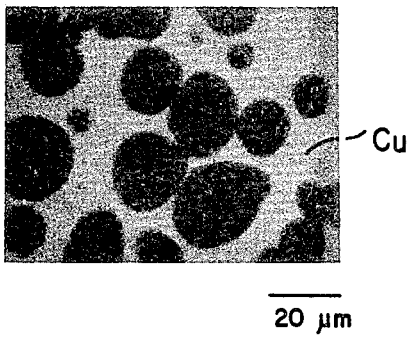

FIG. 15A shows a secondary electron image of a metal structure of Example $A_{10}$. FIG. 15B shows a characteristic X-ray image of distributed iron, in which distributed white insular agglomerates indicate iron. FIG. 15C shows a characteristic X-ray image of distributed chromium, in which distributed gray insular agglomerates indicate chromium. FIG. 15D shows a characteristic X-ray image of distributed nickel, in which distributed gray insular agglomerates indicate nickel. FIG. 15E shows a characteristic X-ray image of infiltrant copper, in which white parts indicate copper.

As apparent from FIGS. 15A to 15E, the particles of austinitic stainless steel SUS304 are bonded to each other, resulting in a porous matrix. Interstices of the porous matrix are infiltrated with copper, which results in a stout structure of the complex metal for the arc-diffusing portion.

Examples $A_{11}$ of the complex metal for the arc-diffusing portion possesses a composition consisting of 70% austinitic stainless steel SUS304 by weight and 30% copper by weight.

Example $A_{12}$ of the complex metal for the arc-diffusing portion possesses a composition consisting of 30% austinitic stainless steel SUS304 by weight and 70% copper by weight.

Measurements of IACS electrical conductivity which were carried out on Examples $A_{10}$ to $A_{12}$ of the complex metal for the arc-diffusing portion and Examples $C_1$ to $C_3$ above of the complex metal for the contact-making portion established that:

Example $A_{10}$, 5 to 15% IACS electrical conductivity

Example $A_{11}$, 4 to 8%

Example $A_{12}$, 10 to 30%

Examples $A_{10}$ to $A_{12}$ of the complex metal for the arc-diffusing portion 20 and Examples $C_1$ to $C_3$ of the complex metal for the contact-making portion 19 are respectively shaped to the same as those of the arc-diffusing portion and the contact-making portion of the 2nd to 10th embodiments of the present invention, and tested as a pair of contact-electrodes in the same manner as in the 2nd and 10th embodiments of the present invention. Results of the test will be described hereinafter. A description shall be made on a vacuum interrupter of the 29th embodiment of the present invention which includes the pair of contact-electrodes each consisting of the arc-diffusing portion 20 made of Example $A_{10}$, and the contact-making portion 19 made of Example $C_1$. An arc-diffusing portion and a contact-making portion of a contact-electrode of a 30th embodiment are made of respective Examples $A_{10}$ and $C_2$. Those of a 31st of Examples $A_{10}$ and $C_3$. Those of a 32nd, of Examples $A_{11}$ and $C_1$. Those of a 33rd, of Examples $A_{11}$ and $C_2$. Those of a 34th, of Examples $A_{11}$ and $C_3$. Those of a 35th, of Examples $A_{12}$ and $C_1$. Those of a 36th, of Examples $A_{12}$ and $C_2$. Those of a 37th, of Examples $A_{12}$ and $C_3$. When performances of the vacuum interrupters of the 30th to 37th embodiments of the present invention differ from those of the 29th embodiment of the present invention, then different points shall be specified.

(16) Large current interrupting capability

Interruption tests which were carried out at an opening speed within 1.2 to 1.5 m/s under a rated voltage of 12 kV, however, a transient recovery voltage of 21 kV according to JEC-181, established that the test vacuum interrupters interrupted, 60 kA current. Moreover, interruption tests at an opening speed of 3.0 m/s under a rated voltage of 84 kV, however, a transient recovery voltage of 143 kV according to JEC-181, established that the test vacuum interrupters interrupted 50 kA current.

Table 5 below shows the results of the large current interrupting capability tests which were carried out on the vacuum interrupters of the 29th to 37th embodiments. Table 5 also shows those of vacuum interrupters of the 13th and 14th comparatives which include a pair of contact-electrodes each consisting of an arc-diffusing portion and a contact-making portion each having the same sizes as those of the arc-portions of the contact-electrodes of the 29th and 37th embodiments of the present invention.

The arc-diffusing portion and the contact-making portion of the 13th comparative are respectively made of Example $A_{10}$ and 20Cu-80W alloy. Those of the 14th comparative, of Example $A_{10}$ and Cu-0.5Bi alloy.

TABLE 5

| Embodiment | Contact-electrode: Arc-diffusing Portion | Contact-electrode: Contact-making Portion | Large Current Interrupting Capability kA: 12 kV | 84 kV |
|---|---|---|---|---|
| No. 29 | Example $A_{10}$ | Example $C_1$ | 60 | 50 |
| 30 | " | Example $C_2$ | 60 | 50 |
| 31 | " | Example $C_3$ | 58 | 48 |
| 32 | Example $A_{11}$ | Example $C_1$ | 57 | 47 |
| 33 | " | Example $C_2$ | 57 | 47 |
| 34 | " | Example $C_3$ | 58 | 48 |
| 35 | Example $A_{12}$ | Example $C_1$ | 59 | 49 |
| 36 | " | Example $C_2$ | 58 | 48 |
| 37 | " | Example $C_3$ | 58 | 48 |
| Comparative 13 | Example $A_{10}$ | 20Cu—80W | 40 | 30 |
| Comparative 14 | " | Cu—0.5Bi | 50 | 30 |

(17) Dielectric strength

In accordance with JEC-181 test method, impulse withstand voltage tests were carried out with a 30 mm inter-contact gap. The vacuum interrupters showed 400 kV withstand voltage against both positive and negative impulses with a ±10 kV deviation.

After 10 times interrupting 60 kA current of rated 12 kV, the same impulse withstand voltage tests were carried out, thus establishing the same results.

After continuously 100 times opening and closing a circuit through which 80A leading small current of rate 12 kV flowed, the same impulse withstand voltage tests were carried out, thus establishing substantially the same results.

Table 6 below shows the results of the tests of the impulse withstand voltage at rated 84 kV tests which were carried out on the vacuum interrupters of the 29th embodiment of the present invention and on them of the 13th and 14th comparatives.

TABLE 6

| Embodiment | Contact-electrode: Arc-diffusing Portion | Contact-electrode: Contact-making Portion | Withstand Voltage kV |
|---|---|---|---|
| No. 29 | Example $A_{10}$ | Example $C_1$ | ±400 |
| Comparative 13 | " | 20Cu—80W | ±400 |
| Comparative 14 | " | Cu—0.5Bi | ±250 |

(18) Anti-welding capability

The same as in item 8).

(19) Lagging small current interrupint capability

In accordance with a lagging small current interrupting test of JEC-181, a 30A test current of $$84 \times \frac{1.5}{\sqrt{3}} \text{ kV}$$

was flowed through the stationary and movable contact-electrodes 24 and 13. Current chopping values had a 3.9A average (however, $\sigma_n=0.96$ and $n=100$).

In particular, current chopping values of the vacuum interrupters of the 30th, 33rd and 36th embodiments of the present invention had respectively a 3.7A average (however, $\sigma_n=1.26$ and $n=100$), and those of the 31st, 34th and 37th embodiments of the present invention had a 3.9A average (however $\sigma_n=1.5$) and $n=100$), respectively.

(20) Leading small current interrupting capability

The same as in item 10).

The following limits were apparent on a composition ratio of austinitic stainless steel in the complex metals for the arc-diffusing portion of the 29th to 37th embodiments of the present invention.

Austinitic stainless steel below 30% by weight significantly increased the electrical conductivity to generate large eddy currents but lowered the mechanical strength and durability of the arc-diffusing portion 20, so that the arc-diffusing portion 20 had to be thickened.

On the other hand, austinitic stainless steel above 70% by weight significantly lowered interruption performances.

The vacuum interrupters of the 29th to 37th embodiments of the present invention possess more improved current interrupting capability than that of a conventional vacuum interrupter of an axial magnetic field applying type and such high dielectric strength as that of the vacuum interrupter of the 13th comparative.

Arc-diffusing portions 20 of the 38th and 40th embodiments are each made of complex metal consisting of a porous structure of austinitic stainless steel including many holes of axial direction through the arc-diffusing portions 20 at an areal occupation ratio of 10 to 90%, and copper or silver infiltrating the porous structure of austinitic stainless steel. This metal composition possesses 5 to 30% IACS electrical conductivity, at least 30 kgf/mm$^2$ (294 MPa) tensile strength and 100 to 180 Hv hardness.

Complex metals for the arc-diffusing portion of the 38th to 40th embodiments of the present invention were produced by the following process.

THE THIRD INFILTRATION PROCESS

At first, a plurality of pipes of austinitic stainless steel, e.g., SUS304 or SUS316 and each having an outer-diameter within 0.1 to 10 mm and a thickness within 0.01 to 9 mm are heated at a temperature below a melting point of the austinitic stainless steel in a nonoxidizing atmosphere, e.g., a vacuum, or hydrogen, nitrogen or argon gas, thus bonded to each other so as to form a porous matrix of a circular section. Then, the resultant porous matrix of the circular section is placed in a vessel made of material, e.g., alumina ceramics, which interacts with none of the austinitic stainless steel, copper and silver. All the bores of the pipes and all the interstices between the pipes are infiltrated with copper or silver in the nonoxidizing atmosphere. After cooling, a desired complex metal for the arc-diffusing portion was resultant.

THE FOURTH INFILTRATION PROCESS

In place of the pipes in the third infiltration process, a plate of austinitic stainless steel and including many holes at an areal occupation ratio of 10 to 90% is used as a porous matrix. On the same subsequent steps as those of the third infiltration process, a desired complex metal for the arc-diffusing portion was resultant.

Contact-making portions of the 38th to 40th embodiments of the present invention are made of complex metal of the same composition as that of the complex metal of the 2nd to 10th embodiments of the present invention.

Example $A_{13}$ of a complex metal for the arc-diffusing portion possesses a composition consisting of 60% austinitic stainless steel SUS304 by weight and 40% copper by weight.

Example $A_{13}$ of the complex metal for the arc-diffusing portion 20 and Examples $C_1$ to $C_3$ above of the complex metal for the contact-making portion were respectively shaped to the same as those of the arc-diffusing portion 20 and the contact-making portion 19 of the 2nd embodiment of the present invention, and tested as a pair of contact-electrodes in the same manner as in the 2nd and 10th embodiments of the present invention. Results of the tests will be described hereinafter. A description shall be made on a vacuum interrupter of the 38th embodiment of the present invention which includes the pair of contact-electrodes each consisting of the arc-diffusing portion made of Example $A_{13}$, and the contact-making portion made of Example $C_1$. An arc-diffusing portion and a contact-making portion of a contact-electrode of the 39th embodiment are made of respective Examples $A_{13}$ and $C_2$. Those of the 40th, of Examples $A_{13}$ and $C_3$.

When performances of the vacuum interrupters of the 39th and 40th embodiments of the present invention differ from those of the 38th embodiment of the present invention, then different points shall be specified.

(21) Large current interrupting capability

Interruption tests which are carried out at an opening speed within 1.2 to 1.5 m/s under a rated voltage of 12 kV, however, a transient recovery voltage of 21 kV according to JEC-181, established that the test vacuum interrupters interrupted 65 kA current. Moreover, interruption tests at an opening speed of 3.0 m/s under a rated voltage of 84 kV, however, a transient recovery voltage of 143 kV according to JEC-181, established that the test vacuum interrupters interrupted 55 kA current.

Table 7 below shows the results of the large current interrupting capability tests. Table 7 also shows those of vacuum interrupters of the 15th and 16th comparatives which include a pair of contact-electrodes each consisting of an arc-diffusing portion and a contact-making portion each having the same sizes as those of the arc-diffusing portions and the contact-making portions of the contact-electrodes of the 3rd to 8th comparatives. The arc-diffusing portion and the contact making portion of the 15th comparative are respectively made of Example $A_{13}$ and 20Cu-80W alloy. Those of the 16th comparative, of Example $A_{13}$ and Cu-0.5Bi alloy.

TABLE 7

| Embodiment | Contact-electrode: Arc-diffusing Portion | Contact-electrode: Contact-making Portion | Large Current Interrupting Capability kA: 12 kV | Large Current Interrupting Capability kA: 84 kV | Rated Load Current Switching Durability at 84 kV Times |
|---|---|---|---|---|---|
| No. 38 | Example $A_{13}$ | Example $C_1$ | 65 | 55 | 5000 |
| 39 | Example $A_{13}$ | Example $C_2$ | 66 | 55 | " |
| 40 | Example $A_{13}$ | Example $C_3$ | 65 | 54 | " |
| Comparative 15 | Example $A_{13}$ | 20Cu—80W | 45 | 35 | " |
| Comparative 16 | Example $A_{13}$ | Cu—0.5Bi | 55 | 35 | " |

(22) Dielectric strength

In accordance with JEC-181 test method, impulse withstand voltage tests were carried out with a 30 mm inter-contact gap. The results showed 400 kV withstand voltage against both positive and negative impulses with a ±10 kV deviation.

After 10 times interrupting 65 kA current of rated 12 kV, the same impulse withstand voltage tests were carried out, thus establishing the same results.

After continuously 100 times opening and closing a circuit through which 80A leading small current of rated 12 kV flowed, the same impulse withstand voltage tests were carried out, thus establishing substantially the same results.

Table 8 below shows the results of the tests of the impulse withstand voltage at rated 84 kV tests which were carried out on the vacuum interrupters of the 38th embodiment of the present invention and those of the 15th and 16th comparatives.

TABLE 8

| Embodiment | Contact-electrode: Arc-diffusing Portion | Contact-electrode: Contact-making Portion | Withstand Voltage kV |
|---|---|---|---|
| No. 38 | Example $A_3$ | Example $C_1$ | ±400 |
| Comparative 15 | " | 20Cu—80W | ±400 |
| Comparative 16 | " | Cu—0.5Bi | ±250 |

TABLE 8-continued

| Embodiment | Contact-electrode Arc-diffusing Portion | Contact-electrode Contact-making Portion | Withstand Voltage kV |
|---|---|---|---|
| tive | | | |

(23) Anti-welding capability

The same as in item 8).

(24) Lagging small current interrupting capability

The same tests as in item 19) established that the vacuum interrupters of the 38th, 39th, and 40th embodiments of the present invention had respective 3.9A ($\sigma_n$=0.96 and n=100), 3.7A ($\sigma_n$=1.26 and n=100) and 3.9A ($\sigma_n$=1.5 and n=100) averages of current chopping value.

(25) Leading small current interrupting capability

The same as in item 10).

In the complex metal for the arc-diffusing portion of the 38th to 40th embodiments of the present invention, the areal occupation ratio below 10% of many holes of axial direction in the plate of austinitic stainless steel significantly decreased the current interrupting capability, on the other hand, the areal occupation ratio above 90% thereof significantly decreased the mechanical strength of the arc-diffusing portion and the dielectric strength of the vacuum interrupter.

The vacuum interrupters of the 38th and 40th of the present invention possess more improved high current interrupting capability than those of other embodiments of the present invention.

A vacuum interrupter of an axial magnetic field applying type of the present invention, of which a contact-making portion of a contact-electrode is made of complex metal consisting of 20 to 70% copper by weight, 5 to 70% chromium by weight and 5 to 70% molybdenum by weight and of which an arc-diffusing portion of the contact-electrode is made of material below, possesses more improved large current interrupting capability, dielectric strength, anti-welding capability, and lagging and leading small current interrupting capabilities than a conventional vacuum interrupter of an axial magnetic field applying type.

There may be listed as a material for an arc-diffusing portion austinitic stainless steel of 2 to 3% IACS electrical conductivity, at least 49 kgf/mm$^2$ (481 MPa) tensile strength and 200 Hv hardness, e.g., SUS304 or SUS316, ferritic stainless steel of about 2.5% IACS electrical conductivity, at least 49 kgf/mm$^2$ (481 MPa) tensile strength and 190 Hv hardness, e.g., SUS405, SUS429, SUS430, SUS430F or SUS434, martensitic stainless steel of about 3.0% IACS electrical conductivity, at least 60 kgf/mm$^2$ (588 MPa) tensile strength and 190 Hv hardness, e.g., SUS403, SUS410, SUS416, SUS420, SUS431 or SUS440C, a complex metal of 5 to 9% IACS electrical conductivity, at least 30 kgf/mm$^2$ (294 MPa) tensile strength and 100 to 180 Hv hardness in which iron, nickel or cobalt, or an alloy as magnetic material including a plurality of holes of axial direction through an arc-diffusing portion at an areal occupation ratio of 10 to 90%, are infiltrated with copper or silver, a complex metal of 2 to 30% IACS electrical conductivity consisting of 5 to 40% iron by weight, 5 to 40% chromium by weight, 1 to 10% molybedenum or tungsten by weight and a balance of copper, a complex metal of 3 to 30% IACS electrical conductivity consisting of 5 to 40% iron by weight, 5 to 40% chromium by weight, molybdenum and tungsten amounting in total to 1 to 10% by weight and either one amounting to 0.5% by weight, and a balance of copper, a complex metal of 3 to 25% IACS electrical conductivity consisting of a 29 to 70% austinitic stainless steel by weight, 1 to 10% molybdenum or tungsten by weight, and a balance of copper, a complex metal of 3 to 25% IACS electrical conductivity consisting of a 29 to 70% ferritic stainless steel by weight, 1 to 10% molybdenum or tungsten by weight, and a balance of copper, a complex metal of 3 to 30% IACS electrical conductivity consisting of a 29 to 70% martensitic stainless steel by weight, 1 to 10% molybdenum or tungsten by weight, and a balance of copper, a complex metal of 3 to 30% IACS electrical conductivity consisting of a 29 to 70% austinitic stainless steel by weight, molybdenum and tungsten amounting in total to 1 to 10% by weight and either one amounting to 0.5% by weight, and a balance of copper, a complex metal of 3 to 30% IACS electrical conductivity consisting of a 29 to 70% martensitic stainless steel by weight, molybdenum and tungsten amounting in total to 1 to 10% by weight and either one amounting to 0.5% by weight, and a balance of copper, and a complex metal of 3 to 25% IACS electrical conductivity consisting of a 29 to 70% ferritic stainless steel by weight, molybdenum and tungsten amounting in total to 1 to 10% by weight and either one amounting to 0.5% by weight, and a balance of copper. The complex metal listed above are produced by substantially the same process as the first, second, thrid or fourth infiltration or sintering process.

What is claimed is:

1. A vacuum interrupter comprising a pair of separable contact-electrodes (13, 24), each of which consists of a disc-shaped arc-diffusing portion (20) and a contact-making portion (19) projecting from a central portion of an arcing surface of the arc-diffusing portion (20), a vacuum envelope (4) which is electrically insulating and enclosing the contact-electrodes (13, 24), and means for applying a magnetic field (14, 30) in parallel to an arc established between the contact-electrodes (13, 24) when said contact-electrodes are separated, wherein said arc-diffusing portion (20) of at least one (13) of the contact-electrodes (13, 24) is made of material of 2 to 30% IACS electrical conductivity and said contact-making portion (19) of said at least one contact-electrode (13) is made of material of 20 to 60% IACS electrical conductivity.

2. A vacuum interrupter as difined in claim 1, wherein said arc-diffusing portion (20) is made of complex metal consisting of 20 to 70% copper by weight, 5 to 40% iron by weight and 5 to 40% chromium by weight.

3. A vacuum interrupter as defined in claim 1, wherein said arc-diffusing portion (20) is made of material including copper, iron and chromium, and said contact-making portion (19) is made of complex metal consisting of copper, chromium and molybdenum.

4. A vacuum interrupter as defined in claim 1, wherein said arc-diffusing portion (20) is made of material of 10 to 15% IACS electrical conductivity.

5. A vacuum interrupter as defined in claim 1, wherein said contact-making portion (19) is made of complex metal consisting of 20 to 70% copper by weight, 5 to 70% chromium by weight and 5 to 70% molybdenum by weight.

6. A vacuum interrupter as defined in claim 1, wherein said arc-diffusing portion (20) is made of complex metal consisting of 30 to 70% copper by weight and 30 to 70% by weight nonmagnetic stainless steel.

7. A vacuum interrupter as defined in claim 5, wherein said arc-diffusing portion (20) is made of complex metal consisting of 30 to 70% copper by weight and 30 to 70% nonmagnetic stainless steel.

8. A vacuum interrupter as defined in claim 1, wherein said arc-diffusing portion (20) is made of complex metal consisting of 30 to 70% copper by weight and a 30 to 70% magnetic stainless steel by weight.

9. A vacuum interrupter as defined in claim 8, wherein said arc-diffusing portion (20) is made of complex metal consisting of 30 to 70% copper by weight and 30 to 70% ferritic stainless steel by weight.

10. A vacuum interrupter as defined in claim 8, wherein said arc-diffusing portion (20) is made of complex metal consisting of 30 to 70% copper by weight and 30 to 70% martensitic stainless steel by weight.

11. A vacuum interrupter as defined in claim 8, wherein said contact-making portion (19) is made of complex metal consisting of 20 to 70% copper by weight, 5 to 70% chromium by weight and 5 to 70% molybdenum by weight.

12. A vacuum interrupter as defined in claim 9, wherein said contact-making portion (19) is made of complex metal consisting of 20 to 70% copper by weight and 5 to 70% chromium by weight and 5 to 70% molybdenum by weight.

13. A vacuum interrupter as defined in claim 10, wherein said contact-making portion (19) is made of complex metal consisting of 20 to 70% copper by weight and 5 to 70% chromium by weight and 5 to 70% molybdenum by weight.

14. A vacuum interrupter as defined in claim 1, wherein said arc-diffusing portion (20) is made of complex metal consisting of a nonmagnetic stainless steel including a plurality of holes of axial direction through said arc-diffusing portion (20) at an areal occupation ratio of 10 to 90%, and infiltrant copper or silver into the nonmagnetic stainless steel, and wherein said contact-making portion (19) is made of complex metal consisting of 20 to 70% copper by weight, 5 to 70% chromium by weight and 5 to 70% molybdenum by weight.

15. A vacuum interrupter as defined in claim 1, wherein said arc-diffusing portion (20) is made of complex metal consisting of a magnetic stainless steel including a plurality of holes of axial direction through said arc-diffusing portion (20) at an areal occupation ratio of 10 to 90%, and infiltrant copper or silver into the magnetic stainless steel, and wherein said contact-making portion (19) is made of complex metal consisting of 20 to 70% copper by weight, 5 to 70% chromium by weight and 5 to 70% molybdenum by weight.

16. A vacuum interrupter as defined in claim 1, wherein said arc-diffusing portion (20) is made of austinitic stainless steel of 2 to 3% IACS electrical conductivity.

17. A vacuum interrupter as defined in claim 1, wherein said arc-diffusing portion (20) is made of ferritic stainless steel of about 2.5% IACS electrical conductivity.

18. A vacuum interrupter as defined in claim 1, wherein said arc-diffusing portion is made of martensitic stainless steel of about 3.0% IACS electrical conductivity.

19. A vacuum interrupter as defined in claim 1, wherein said magnetic field applying means (14, 15) comprises a coil-electrode (15) positioned apart from and behind said arc-diffusing portion (20) and an electrical lead member (14) for the coil-electrode, which is made of material of electrical conductivity higher than that of the material for said arc-diffusing portion (20), electrically connected to the coil-electrode (15) and all the portions (22, 25, 26) of which are mechanically and electrically connected to a backsurface of said arc-diffusing portion (20).

* * * * *